US011293381B1

(12) United States Patent
Dudar

(10) Patent No.: US 11,293,381 B1
(45) Date of Patent: Apr. 5, 2022

(54) CPV ROBUSTNESS METHOD FOR A VEHICLE EVAPORATIVE EMISSIONS CONTROL SYSTEM

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/150,248

(22) Filed: Jan. 15, 2021

(51) Int. Cl.
*F02M 25/08* (2006.01)
*F02D 41/06* (2006.01)
*F02D 41/00* (2006.01)

(52) U.S. Cl.
CPC ..... *F02M 25/0818* (2013.01); *F02D 41/004* (2013.01); *F02D 41/065* (2013.01); *F02M 25/0836* (2013.01); *F02D 2200/0602* (2013.01); *F02D 2200/0606* (2013.01)

(58) Field of Classification Search
CPC ..... F02M 25/0818; F02M 25/0836; F02D 41/004; F02D 41/065; F02D 2200/0602; F02D 2200/0606
See application file for complete search history.

(56) References Cited

U.S. PATENT DOCUMENTS

| | | | | |
|---|---|---|---|---|
| 5,806,500 | A * | 9/1998 | Fargo | F02M 25/089 123/198 D |
| 9,243,592 | B2 | 1/2016 | Dudar et al. | |
| 9,732,685 | B2 | 8/2017 | Dudar | |
| 10,830,189 | B1 | 11/2020 | Dudar | |
| 11,073,094 | B1 * | 7/2021 | Dudar | F02D 41/221 |
| 2020/0369508 | A1 | 11/2020 | Dudar | |

OTHER PUBLICATIONS

Bomey, N., "Ford recalls 1.5 million Ford Focus cars that could stall with fuel tank problem," USA Today, Available Online at https://www.usatoday.com/story/money/cars/2018/10/25/ford-focus-recall-1-5-m-cars-fixed-avoid-potential-stalling/1759870002/, Oct. 25, 2018, 1 page.

Dudar, A.. "Fuel Vapor System Valve Monitoring," U.S. Appl. No. 16/850,565, filed Apr. 16, 2020, 45 pages.

* cited by examiner

*Primary Examiner* — Xiao En Mo
(74) *Attorney, Agent, or Firm* — Geoffrey Brumbaugh; McCoy Russell LLP

(57) ABSTRACT

Methods and systems are provided for monitoring corking of a canister vent valve (CVS) in a fuel vapor line during diagnostics of an evaporative emissions control (EVAP) system of a vehicle. In one example, a method includes, after isolating the EVAP system from atmosphere, opening each bypass valve of one or more bypass valves of one or more fuel vapor canisters to couple the EVAP system to a fuel system of the vehicle, and opening a canister vent valve (CVS) responsive to an EVAP system pressure decreasing to a threshold EVAP system pressure.

16 Claims, 10 Drawing Sheets

CPV ROBUSTNESS METHOD FOR A VEHICLE EVAPORATIVE EMISSIONS CONTROL SYSTEM

FIELD

The present description relates generally to methods and systems for monitoring corking of a valve in a fuel vapor system during diagnostics of the fuel vapor system.

BACKGROUND/SUMMARY

Vehicles may be fitted with evaporative emissions control (EVAP) systems to reduce the release of fuel vapors to the atmosphere. For example, vaporized hydrocarbons (HCs) from a fuel tank may be stored in a fuel vapor canister packed with an adsorbent which adsorbs and stores the fuel vapors. At a later time, when the engine is in operation, the EVAP system allows the fuel vapors to be purged into the engine intake manifold from the fuel vapor canister. The fuel vapors are then consumed during combustion.

During certain conditions, the EVAP system may be monitored to identify breaches that may result in unwanted fuel vapor leaks. For example, a degraded canister purge valve (CPV) coupling the EVAP system to an engine manifold may reduce an efficiency of the EVAP system during purges, where a fuel vapor load of the fuel vapor canister may not be purged. If the fuel vapor canister is loaded and the engine is switched off during an idle-stop event (e.g., at a traffic stop), upon engine restart, fuel vapor from the loaded canister may enter the engine via the degraded CPV causing combustion of an over-enriched mixture of air and fuel, which may increase a probability of misfire and engine stalls.

An EVAP system diagnostic routine may determine if the CPV is degraded. One example approach to detection of a degraded CPV includes, during engine operation, sealing the EVAP system and monitoring development of negative pressure in the EVAP system via a fuel tank pressure transducer (FTPT) of the vehicle. If an EVAP system pressure decreases, a diagnostic flag may be set indicating a degraded CPV. However, if a degradation of the CPV is large, the EVAP system pressure may decrease quickly, causing the CVS to become corked closed (e.g., vacuum sealed). If the CVS is corked closed, an excessive level of vacuum may be applied to fuel system components such as the fuel tank, which may cause deformation of the fuel tank. Additionally, if the CVS is corked closed, it may not be possible to effectively purge the fuel vapors into the engine intake manifold from the fuel vapor canister.

One approach to preventing CVS corking during the EVAP system diagnostic routine is to open the CVS prior to the EVAP system pressure decreasing to a threshold negative pressure (e.g., a corking pressure). However, the inventors herein have recognized potential issues with this approach. In particular, the inventors have recognized that if there are multiple canisters arranged between the CPV and a FTPT, there may be a lag between the EVAP system pressure as measured by the FTPT and the pressure at the CVS. As a result, the EVAP system pressure at the CVS may exceed the threshold EVAP system pressure prior to the EVAP system pressure measured at the FTPT reaching the threshold EVAP system pressure. If the CVS is commanded open at the threshold EVAP system pressure as estimated via the FTPT sensor, since the actual pressure at the CVS may be higher than that recorded by the FTPT, the CVS may not be opened in time, which may cause CVS corking.

In one example, the issues described above may be addressed by a method for an EVAP system of a vehicle, comprising, after isolating the EVAP system from atmosphere, opening each bypass valve of one or more bypass valves of one or more fuel vapor canisters to couple the EVAP system to a fuel system of the vehicle, and opening the CVS responsive to an EVAP system pressure decreasing to a threshold EVAP system pressure. In this way, by opening the bypass valves of the canisters, the pressure of the fuel vapor system estimated by the FTPT may be equal to the actual pressure at the CVS, whereby a measurement of the pressure at the FTPT may be relied on to actuate the CVS open prior to corking. The bypass valves of one or more loaded canisters may also be opened during an engine idle-stop event, thereby allowing fresh air to bypass the loaded canisters and enter the engine intake to be mixed with fuel for an engine restart. By injecting fuel into a stream of fresh air rather than a mixture of air and fuel vapors, an air/fuel ratio may be more accurately controlled, reducing a probability of engine stall or misfire upon the engine restart.

As an example, during engine operation and upon conditions being met, an EVAP system diagnostic routine may be carried out. In order to detect degradation of the EVAP system such as the CPV being stuck in an open position, the CPV valve and the CVS valve may be commanded to their respective closed positions while a fuel tank isolation valve (FTIV) positioned between the fuel tank and the fuel vapor canister may be commanded to an open position, thereby isolating the EVAP system from the engine manifold and the atmosphere. If the CPV is stuck in an at least partially open position, negative pressure from the engine intake manifold may be transmitted to the EVAP system, indicating a degraded CPV. During generation of the negative pressure, the bypass valves of each canister may be commanded open, thereby equalizing the EVAP system pressure at the CVS and the FTPT. As a result of the EVAP system pressure (negative pressure) at the FTPT being equal to the EVAP system pressure (negative pressure) at the CVS, a timely measurement of the EVAP system pressure at the CVS may be registered by the FTPT. If the EVAP system pressure decreases to the threshold EVAP system pressure, the CVS may be commanded open to increase the EVAP system pressure to avert CVS corking, regardless of the degree of completion of the diagnostic routine. The bypass valves may also be commanded open during an engine idle-stop mode of the vehicle, so that when the engine restarts, an air/fuel ratio of the engine may be controlled by injecting fuel into a stream of fresh air that bypasses one or more loaded canisters via the bypass valves, rather than into a stream of air and fuel vapors of an unknown air/fuel ratio from the one or more loaded canisters thereby averting engine misfires or stalls.

In this way, by bypassing each canister and fluidically coupling the CVS to the FTPT, pressure at the CVS may be monitored via the FTPT. By preemptively opening the CVS based on output of the FTPT, corking of the CVS valve may be averted, and an efficiency of the EVAP system may be maintained. Further, by opening the CVS prior to the valve being stuck closed due to the EVAP system pressure decreasing to a threshold EVAP system pressure, hardware degradation may be averted. The preemptive opening of the CVS may be carried out even during conditions when a degradation (such as leak) in the CPV has not yet been detected. In addition, early warranty issues for the EVAP system may be avoided. An additional advantage of opening the bypass valves to equalize the EVAP system pressure during the routine is that a development of negative pressure in the EVAP system due to the degraded CPV is slowed down, thereby providing an additional time to open the CVS and further ensuring that the CVS does not become corked. Additionally, engine stalls resulting from a decrease in canister purging efficiency due to the degraded CPV may be averted by opening one or more bypass valves during an engine idle-stop mode of the vehicle.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
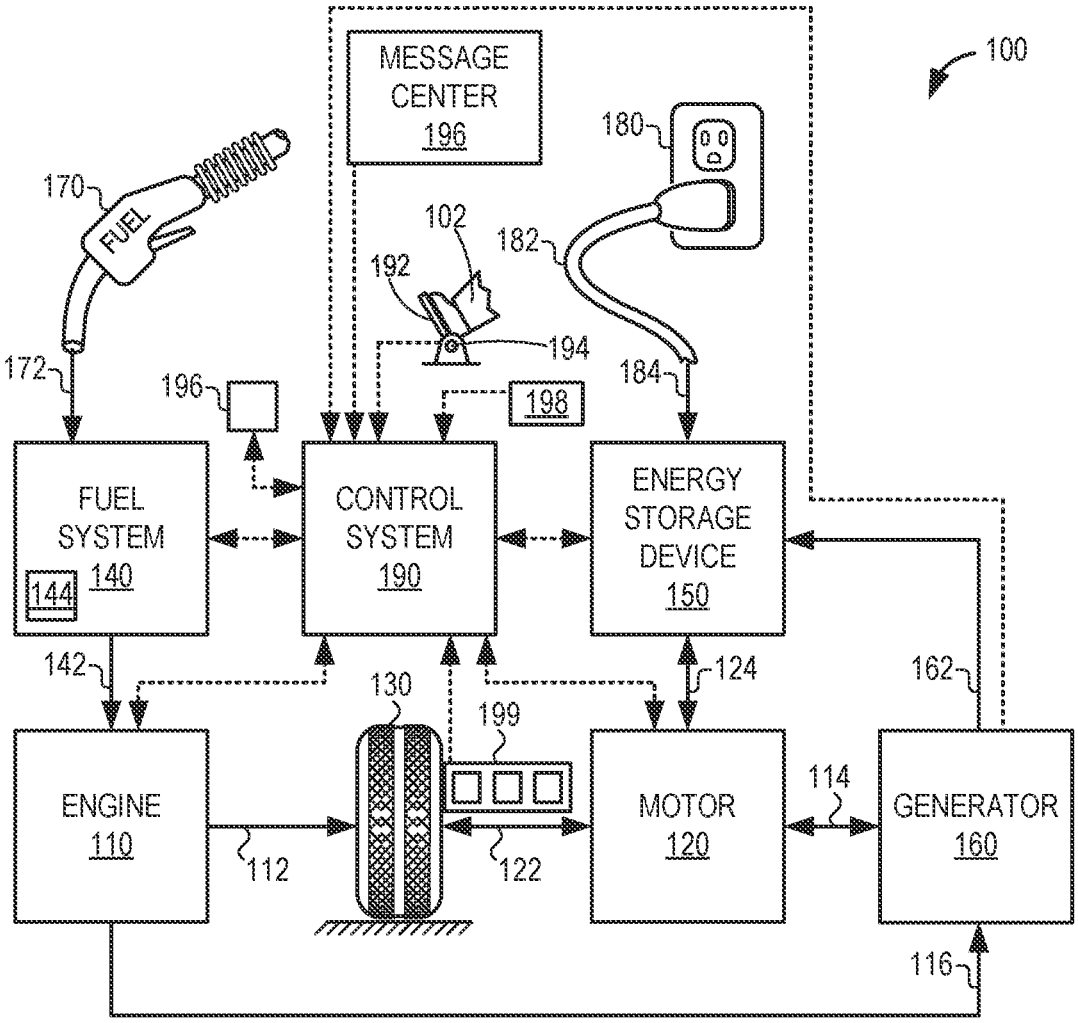
FIG. 1 shows an example hybrid vehicle propulsion system.
Figure 2:
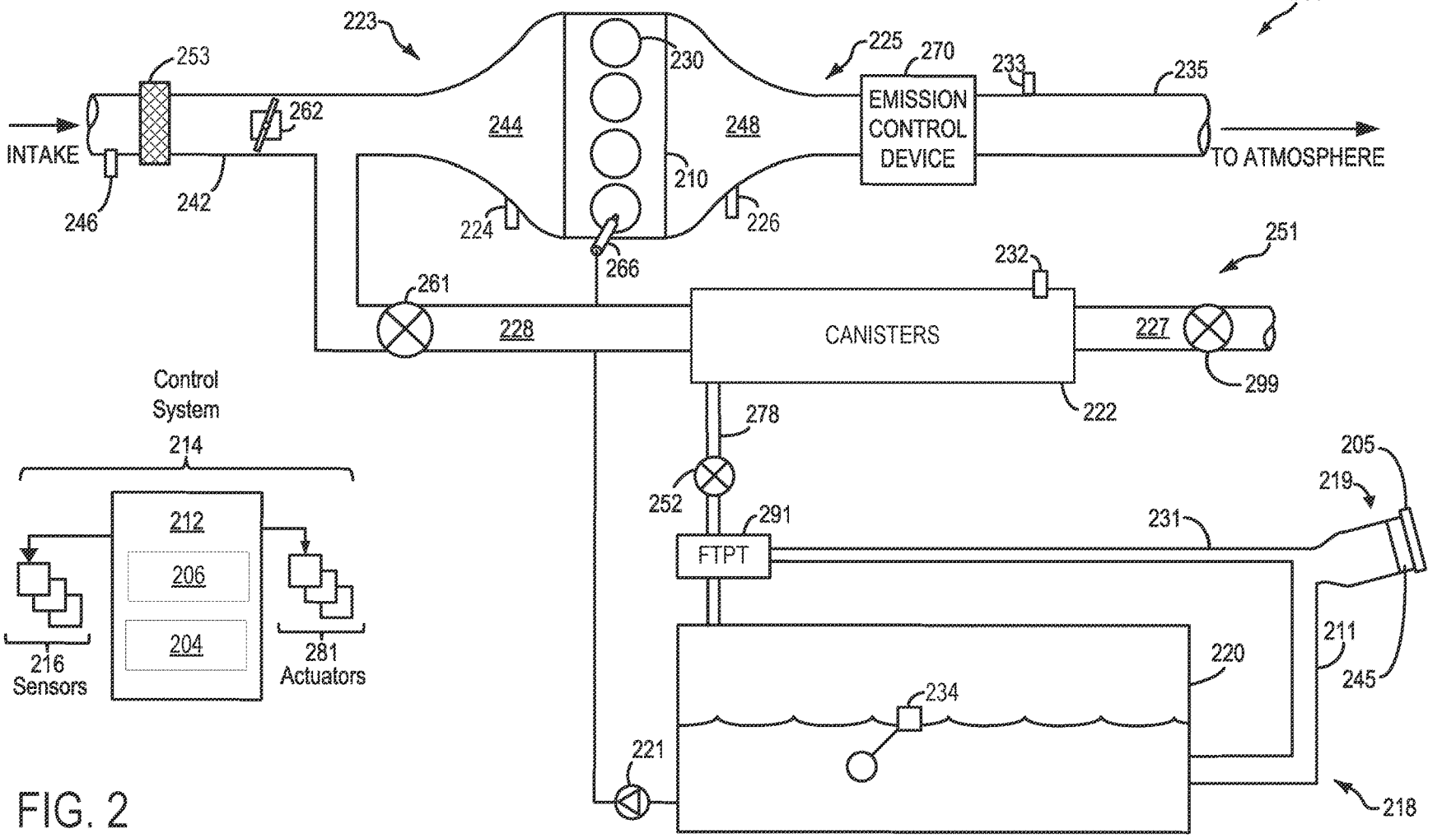
FIG. 2 shows an example vehicle engine system including a fuel system and an evaporative emissions control (EVAP) system.
Figure 3A:
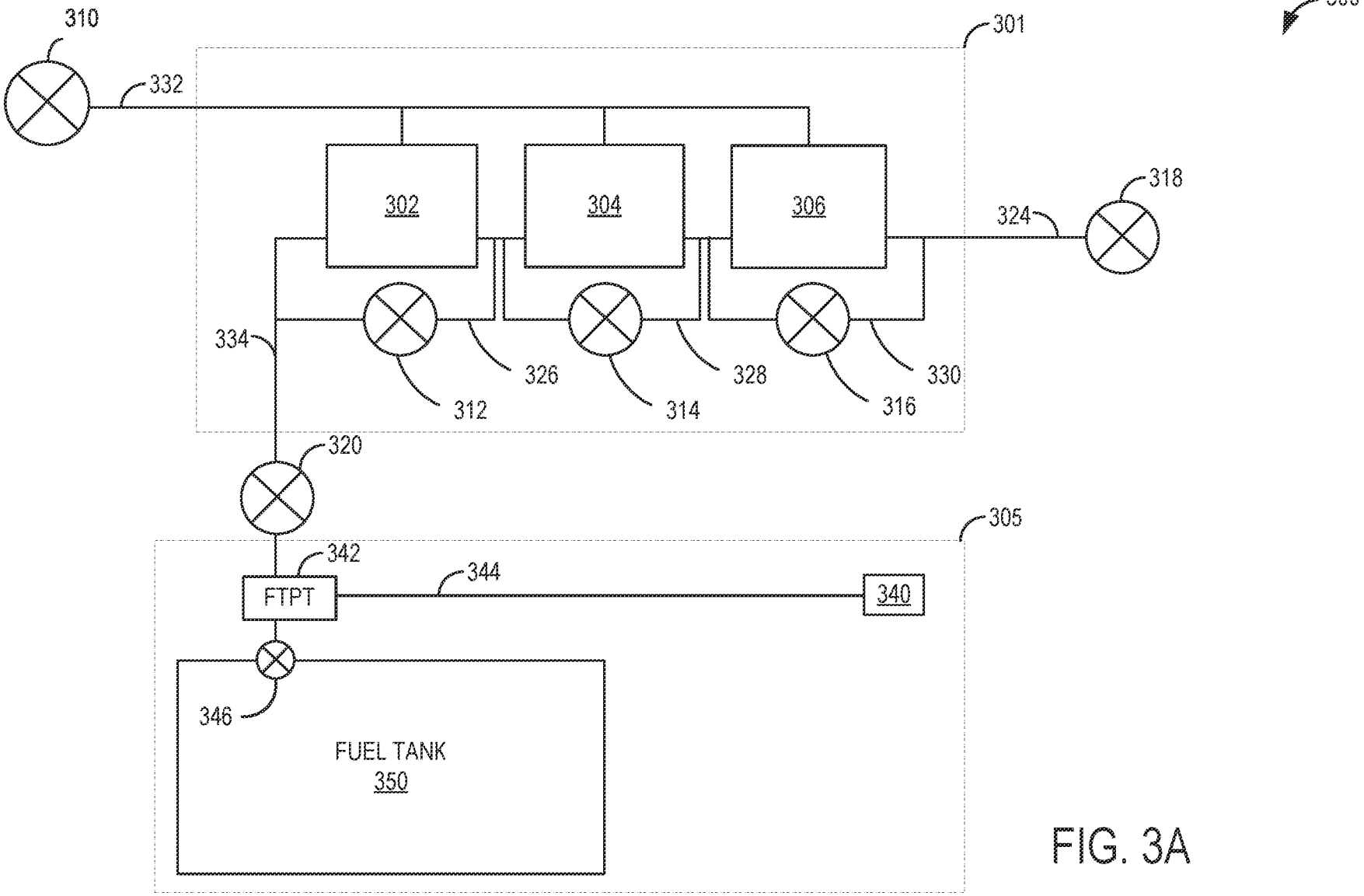
FIG. 3A shows an example EVAP system with three vapor canisters and three bypass valves.
Figure 3B:
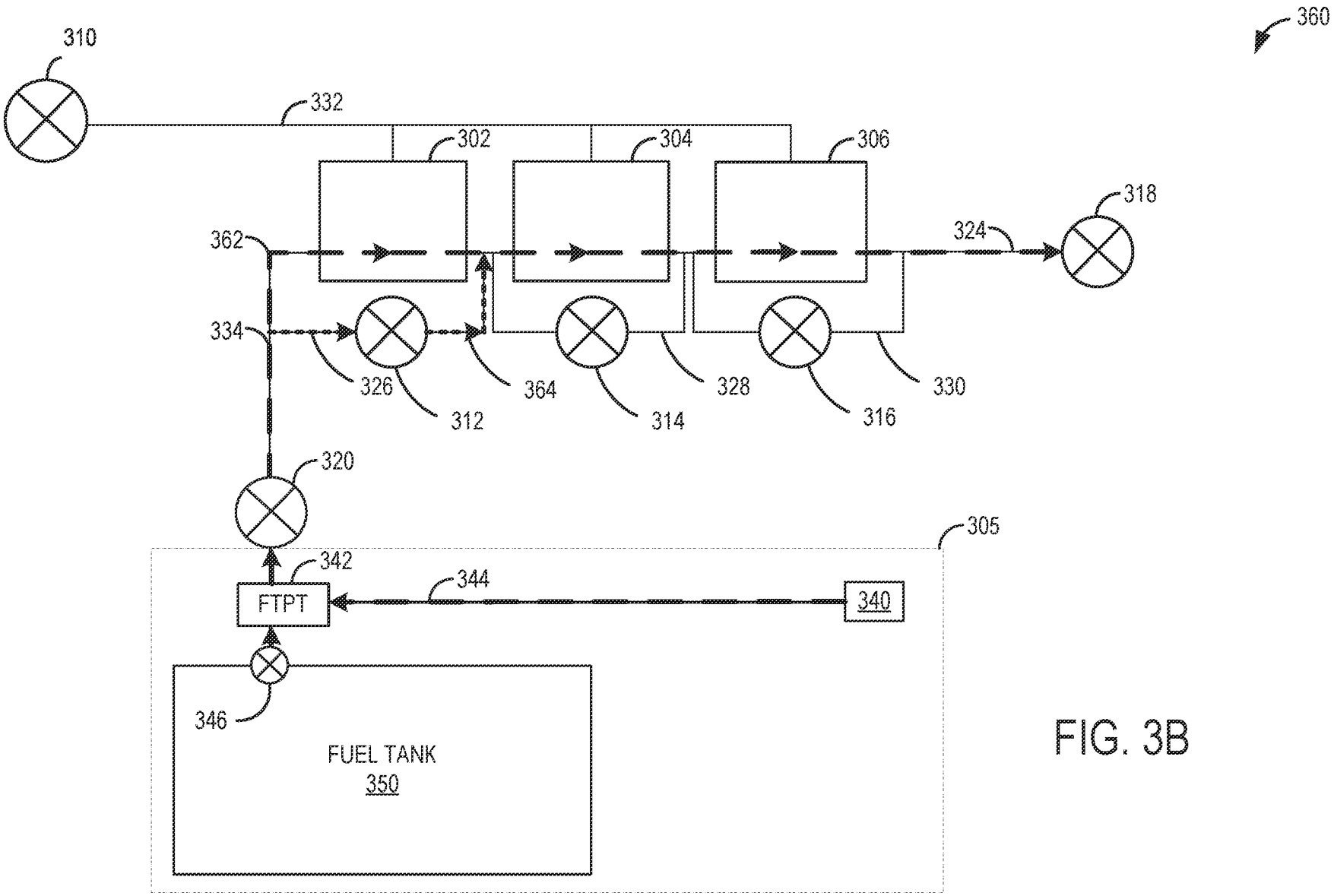
FIG. 3B shows a direction of fuel vapors of the example EVAP system of 3A during a first condition.
Figure 3C:
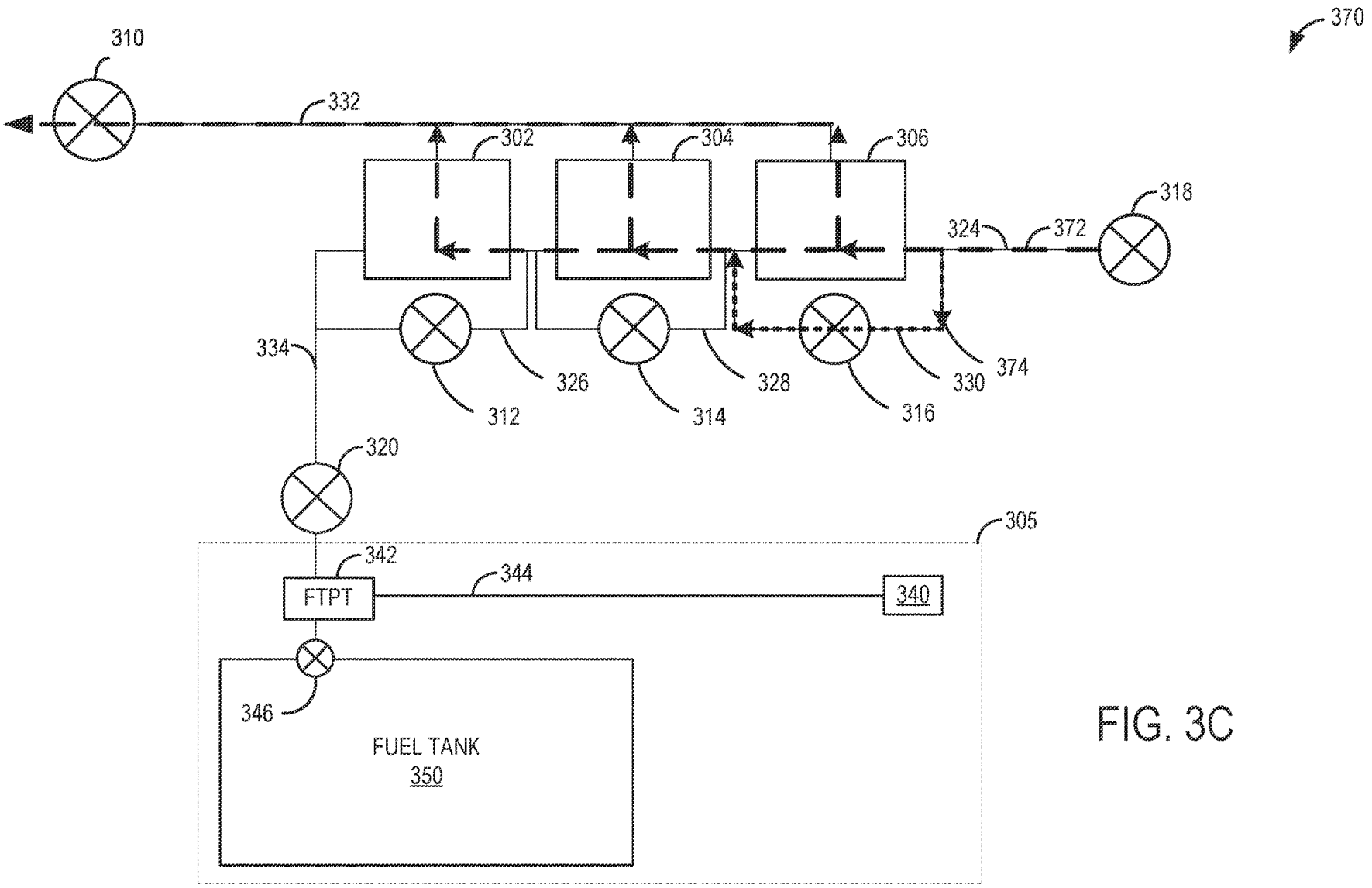
FIG. 3C shows a direction of fuel vapors of the example EVAP system of 3A during a second condition.
Figure 3D:
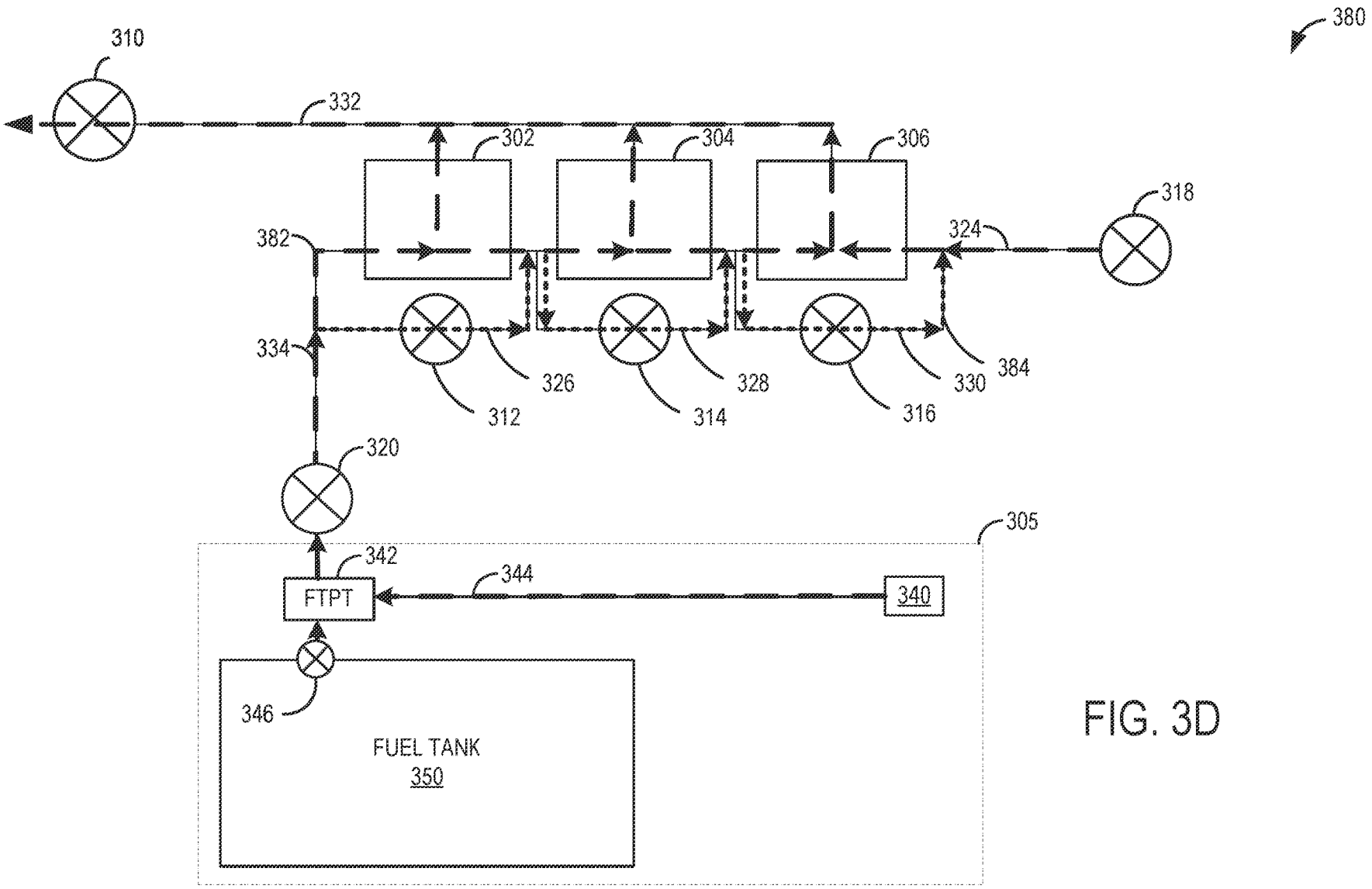
FIG. 3D shows a direction of air and fuel vapors of the example EVAP system of 3A during a third condition.
Figure 3E:
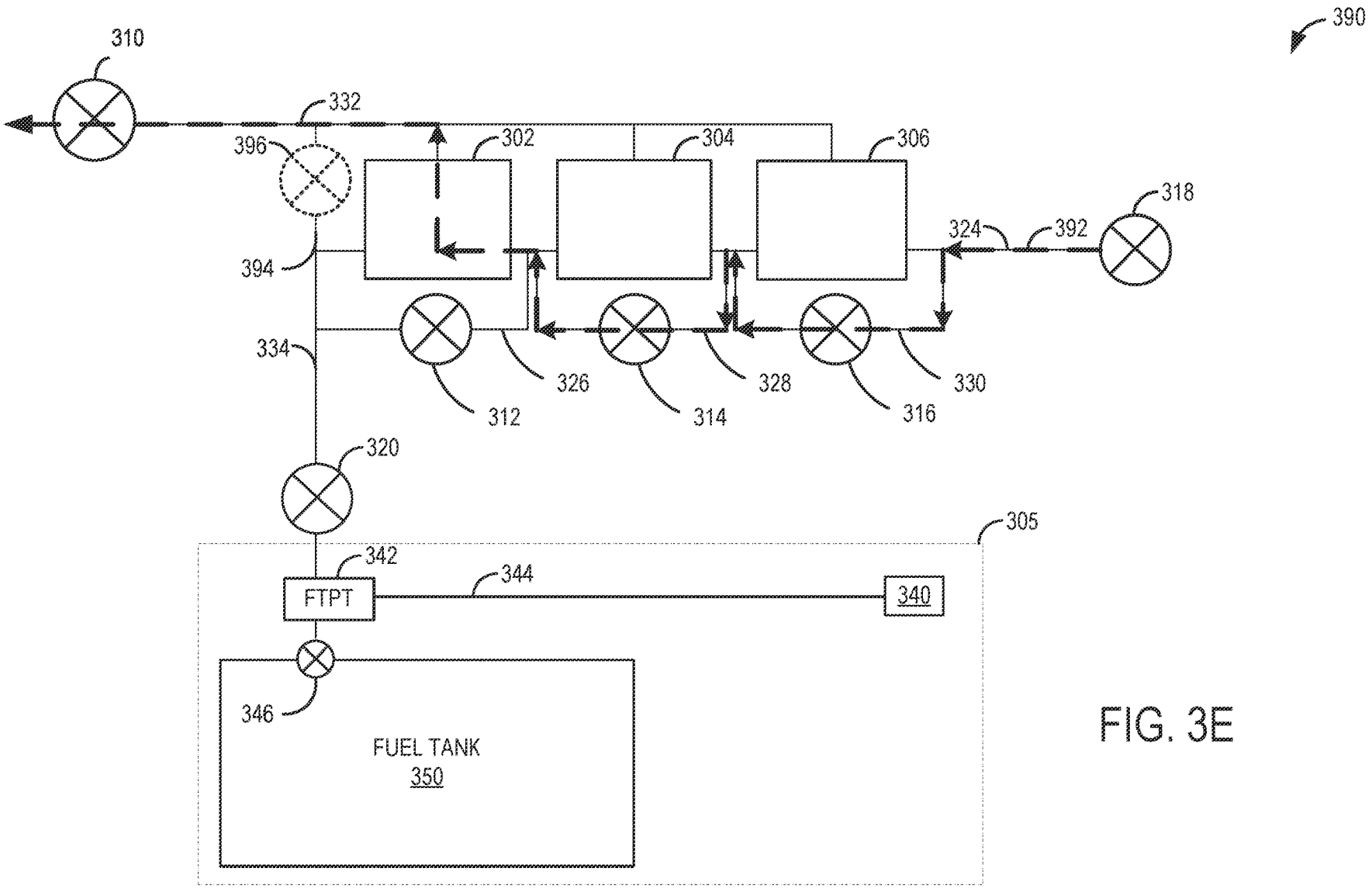
FIG. 3E shows a direction of fresh air through the example EVAP system of 3A during an fourth condition.

The following description relates to systems and methods for monitoring corking of a valve in an evaporative emissions control (EVAP) system during diagnostics of the EVAP system. A hybrid vehicle propulsion system configured to operate with one or both of motor torque from an electric motor and engine torque from an internal combustion engine is shown in FIG. 1. FIG. 2 shows an engine system of the hybrid vehicle, which may include a fuel system and an EVAP system. The EVAP system may include a canister purge valve (CPV) in a purge line coupling the engine manifold to a plurality of canisters storing fuel vapor and a canister vent valve (CVS) in a vent line coupling the canister to the atmosphere. A fuel tank pressure transducer (FTPT) may be coupled to a vapor recovery line of the EVAP system to determine fuel tank pressure. The EVAP system may include a plurality of vapor canisters, each vapor canister with a bypass valve, as shown in FIG. 3A. FIG. 3B shows a direction of a flow of fuel vapors from the fuel system to the plurality vapor canisters during a loading stage. FIG. 3C shows a direction of a flow of fuel vapors through the plurality of vapor canisters and through the CPV during a purge stage. FIG. 3D shows a direction of a flow of fuel vapors from the fuel system through the plurality of vapor canisters and through the CPV during a diagnostic routine. FIG. 3E shows a direction of a flow of fresh air that bypasses one or more of the plurality of vapor canisters during an engine idle-stop of the vehicle (e.g., during a traffic stop), in preparation for a hot restart of the engine. An engine controller may be configured to perform a control routine, such as the example routine of FIG. 4, to monitor corking of the CVS valve while testing for valve degradation. An example routine of FIG. 5 may be carried out to allow fresh air to bypass one or more of the plurality of vapor canisters during a hot restart of the vehicle propulsion system immediately following an idle-stop event. FIG. 6 shows an example monitoring of EVAP system valve positions and EVAP system pressure during a diagnostic routine of the EVAP system.

Regarding terminology, as used herein, a vacuum may also be termed "negative pressure". Both vacuum and negative pressure refer to a pressure lower than atmospheric pressure. Further, an increase in vacuum may cause a higher level of vacuum as the vacuum approaches absolute zero pressure or perfect vacuum. When vacuum decreases, a level of vacuum reduces as the vacuum approaches atmospheric pressure level. In other words, lower vacuum may be a negative pressure that is closer to atmospheric pressure than a higher (or deeper) level of vacuum. A pressure may be termed positive pressure when the pressure is higher than atmospheric (or barometric) pressure. As used herein, an increase in negative pressure is equivalent to a decrease in pressure.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV) or simply a hybrid vehicle. Alternatively, the propulsion system 100 depicted herein may be termed a plug-in hybrid electric vehicle (PHEV).

Vehicle propulsion system 100 may be operated in a variety of different operational modes depending on operating conditions encountered by the vehicle propulsion system. Some of these modes may enable engine 110 to be maintained in an off state (e.g., set to a deactivated state) where combustion of fuel at the engine is discontinued. For example, under select operating conditions, motor 120 may propel the vehicle via drive wheel 130 as indicated by arrow 122 while engine 110 is deactivated (herein also referred to as an electric mode). Herein, the engine may be shut down to rest while the motor propels vehicle motion.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator operation in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated (herein also referred to as an engine mode). During other operating conditions, both engine 110 and motor 120 may each be operated to propel the vehicle via drive wheel 130 as indicated by arrows 112 and 122, respectively (herein also referred to as an assist mode). A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator operation to convert the engine output to electrical energy, where the electrical energy may be stored at energy storage device 150 for later use by the motor.

Fuel system 140 may include one or more fuel tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Thus, liquid fuel may be supplied from fuel tank 144 to engine 110 of the motor vehicle shown in FIG. 1. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

The vehicle propulsion system 100 may also include an ambient temperature/humidity sensor 198 and a roll stability control sensor, such as a lateral and/or longitudinal and/or yaw rate sensor(s) 199. Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

FIG. 2 shows a schematic depiction of a vehicle system 200. The vehicle system 200 includes an engine system 208 coupled to a fuel system 218 and an EVAP system 251. EVAP system 251 includes one or more fuel vapor containers or fuel vapor canisters 222 which may be used to capture and store fuel vapors.

In some examples, vehicle system 200 may be a hybrid electric vehicle system, such as the vehicle propulsion system 100 of FIG. 1. The engine system 208 may include an engine 210 having a plurality of cylinders 230. As such, engine 210 may be to the same as engine 110 of FIG. 1 while control system 214 of FIG. 2 may be the same as control system 190 of FIG. 1.

The engine 210 includes an engine intake 223 and an engine exhaust 225. The engine intake 223 includes a throttle 262 fluidly coupled to the intake manifold 244. Fresh intake air enters intake passage 242 and flows through air filter 253. Air filter 253 positioned in the intake passage 242 may clean intake air before the intake air is directed to the intake manifold 244. Cleaned intake air exiting the air filter 253 may stream past throttle 262 (also termed intake throttle 262) into intake manifold 244 via intake passage 242. As such, intake throttle 262, when fully opened, may enable a higher level of fluidic communication between intake manifold 244 and intake passage 242 downstream of air filter 253. An amount of intake air provided to the intake manifold 244 may be regulated via throttle 262 based on engine operating conditions. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. The emission control devices 270 may include a universal exhaust gas oxygen (UEGO) sensor, which may be used to estimate a combustion air/fuel ratio from a measurement of oxygen in exhaust gas of the vehicle. It will be appreciated that other components may be included in the engine such as a variety of valves and sensors.

The vehicle system 200 may include a control system 214. Control system 214 is shown receiving information from a plurality of sensors 216 (examples of which are described herein) and sending control signals to a plurality of actuators 281 (examples of which are described herein). As one example, sensors 216 may include manifold absolute pressure (MAP) sensor 224, barometric pressure (BP) sensor 246, exhaust gas sensor 226 located in exhaust manifold 248 upstream of the emission control device, temperature sensor 233, fuel tank pressure sensor 291 (also termed a fuel tank pressure transducer or FTPT), and one or more canister temperature sensors 232. Other sensors such as pressure, temperature, air/fuel ratio, and composition sensors may be coupled to various locations in the vehicle system 200. As another example, the actuators may include CPV 261, fuel injector 266, throttle 262, FTIV 252, fuel pump 221, and refueling lock 245. It should be appreciated that the examples provided herein are for illustrative purposes and other types of sensors and/or actuators may be included without departing from the scope of this disclosure.

The control system 214 may include a controller 212. The controller may receive input data from the various sensors, process the input data, and trigger the actuators in response to the processed input data based on instruction or code programmed therein corresponding to one or more routines. The controller 212 may include a processor 204. The processor 204 may generally include any number of microprocessors, ASICs, ICs, etc. The controller 212 may include a memory 206 (e.g., FLASH, ROM, RAM, EPROM and/or EEPROM) that stores instructions that may be executed to carry out one more control routines. As discussed herein, memory includes any non-transient computer readable medium in which programming instructions are stored. For the purposes of this disclosure, the term tangible computer readable medium is expressly defined to include any type of computer readable storage. The example methods and systems may be implemented using coded instruction (e.g., computer readable instructions) stored on a non-transient computer readable medium such as a flash memory, a read-only memory (ROM), a random-access memory (RAM), a cache, or any other storage media in which information is stored for any duration (e.g. for extended period time periods, permanently, brief instances, for temporarily buffering, and/or for caching of the information). Computer memory of computer readable storage mediums as referenced herein may include volatile and non-volatile or removable and non-removable media for a storage of electronic-formatted information such as computer readable program instructions or modules of computer readable program instructions, data, etc. that may be stand-alone or as part of a computing device. Examples of computer memory may include any other medium which can be used to store the desired electronic format of information and which can be accessed by the processor or processors or at least a portion of a computing device.

The controller 212 receives signals from the various sensors of FIG. 2 and employs the various actuators of FIG. 2 to adjust engine operation based on the received signals and instructions stored on the memory 206 of the controller 212. For example, adjusting the CPV may include adjusting an actuator of the CPV to adjust a flow rate of fuel vapors there-through. As such, controller 212 may communicate a signal to the actuator (e.g., CPV solenoid) of the CPV based on a desired purge flow rate. Accordingly, the CPV solenoid may be opened (and pulsed) at a specific duty cycle to enable a flow of stored vapors from canisters 222 to intake manifold 244 via purge line 228.

Fuel system 218 may include a fuel tank 220 coupled to a fuel pump system 221. The fuel pump system 221 may include one or more pumps for pressurizing fuel delivered to the injectors of engine 210, such as the example injector 266. While only a single injector 266 is shown, additional injectors are provided for each cylinder. It will be appreciated that fuel system 218 may be a return-less fuel system, a return fuel system, or various other types of fuel system.

Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

EVAP system 251 may include one or more emissions control devices, such as the one or more fuel vapor canisters 222 (also termed, canisters 222) filled with an appropriate adsorbent. The canisters are configured to temporarily trap fuel vapors (including vaporized hydrocarbons) during fuel tank refilling operations and "running loss" (that is, fuel vaporized during vehicle operation). In one example, the adsorbent used is activated charcoal. Vapors generated in fuel system 218 may be routed to EVAP system 251, via vapor recovery line 231. Fuel vapors stored in fuel vapor canisters 222 may be purged to the engine intake 223 at a later time. Vapor recovery line 231 may be coupled to fuel tank 220 via one or more conduits and may include one or more valves for isolating the fuel tank during certain conditions. EVAP system 251 may further include a canister ventilation path or vent line 227 which may route gases out of the canisters 222 to the atmosphere.

Vent line 227 may allow fresh air to be drawn into canisters 222 when purging stored fuel vapors from canisters 222 to engine intake 223 via purge line 228 and CPV 261 (also termed, purge valve 261). For example, purge valve 261 may be normally closed but may be opened during certain conditions so that vacuum from engine intake manifold 244 is applied to the fuel vapor canisters 222 for purging.

In some examples, the flow of air between canisters 222 and the atmosphere may be regulated by a CVS 299 coupled within vent line 227. A fuel tank isolation valve (FTIV) 252 may be positioned between the fuel tank and the fuel vapor canister within conduit 278. FTIV 252 may be a normally closed valve, that when opened, allows for the venting of fuel vapors from fuel tank 220 to canisters 222. Fuel vapors may be stored within canisters 222 and air, stripped off fuel vapors, may then be vented to atmosphere via vent line 227. Fuel vapors stored in fuel vapor canisters 222 may be purged along purge line 228 to engine intake 223 via CPV 261 at a later time when purging conditions exist. As such, FTIV 252 when closed may isolate and seal the fuel tank 220 from the EVAP system 251.

In some examples, recovery line 231 may be coupled to a fuel filler system 219 (or refueling system 219). In some examples, fuel filler system may include a fuel cap 205 for sealing off the fuel filler system from the atmosphere. Refueling system 219 is coupled to fuel tank 220 via a fuel filler pipe or neck 211. Further, refueling system 219 may include refueling lock 245. In some embodiments, refueling lock 245 may be a fuel cap locking mechanism.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open FTIV 252 while closing CPV 261 to direct refueling vapors into canisters 222 before venting the air to the atmosphere.

As another example, the fuel system may be operated in a refueling mode (e.g., when fuel tank refueling is requested by a vehicle operator), wherein the controller 212 may open FTIV 252, while maintaining CPV 261 closed, to depressurize the fuel tank before allowing fuel to be added therein. As such, FTIV 252 may be kept open during the refueling operation to allow refueling vapors to be stored in the canister. After refueling is completed, the FTIV may be closed.

As yet another example, the fuel system may be operated in a canister purging mode (e.g., after an emission control device light-off temperature has been attained and with the engine running), wherein the controller 212 may open CPV 261 while closing FTIV 252. Herein, the vacuum generated by the intake manifold of the operating engine may be used to draw fresh air through vent line 227 and through fuel vapor canisters 222 to purge the stored fuel vapors into intake manifold 244. In this mode, the purged fuel vapors from the canister are combusted in the engine. The purging may be performed opportunistically, such as when the hybrid vehicle is operated in an engine mode, and/or continued until the stored fuel vapor amount in the canister is below a threshold.

Degradation detection routines may be intermittently performed by controller 212 on EVAP system 251 and fuel system 218 to confirm that the fuel system is not degraded. In one example, leak detection routines may be performed while the engine is running by operating a vacuum pump and/or using engine intake manifold vacuum. For example, a diagnostic routine of the EVAP system may be carried out upon entry conditions being met such as when the engine is in operation. During a diagnostics routine, each of the CPV 261 and CVS 299 may be closed while the FTIV 252 may be opened. Since the fuel vapor system is sealed, in the absence of a degradation, the pressure in the vapor recovery line, as estimated via the FTPT 291, may not change significantly. However, if there is an opening in the CPV 261 such as a leak, due to engine operation, air may flow out of the EVAP system via the opening of the CPV 261 and vacuum from the engine intake manifold may be transferred to the EVAP system via the CPV 261. If the EVAP system pressure reaches a threshold EVAP system (lower) pressure, degradation of the CPV 261 may be indicated.

During the diagnostic routine for the EVAP system, if the CPV 261 is stuck in an open position, due to the vacuum build up in the EVAP system, the CVS 299 which has been closed for the diagnostic routine may be corked such as vacuum sealed. Vacuum sealing of the CVS 299 may cause CVS 299 to be stuck in a closed positon and CVS 299 may not be opened after completion of the diagnostic routine. Corking of the CVS 299 may cause hardware degradation such as damage to the fuel tank. Further, closing of the CVS 299 may hinder purging of the canister which may adversely affect emissions compliance.

While the diagnostic routine is being carried out, a threshold pressure of the fuel vapor system may be estimated and the CVS 299 may be opened responsive to a pressure of the fuel vapor system decreasing to the threshold pressure, regardless of a degree of completion of the diagnostic routine. By opening the CVS 299 in time, corking of the CVS 299 may be averted. Also, in response to the EVAP system pressure decreasing to the threshold pressure, degradation of the fuel vapor system may be indicated (such as a leak in the CPV 261) and the diagnostic routine may be discontinued.

Referring now to FIG. 3A, an example EVAP system 300 of a vehicle is shown, which may be the same as or similar to the EVAP system 251 of FIG. 2, connected to a fuel system 305 of the vehicle. EVAP system 300 may have a plurality of canisters 301 arranged between a CPV 310 (e.g., leading to an engine intake manifold) coupled to a purge line 332 and a CVS 318 coupled to a vent line 324. The canisters 301 may be further coupled to the fuel system 305, including the fuel tank 350 and a vapor recovery line 344 coupled to a fuel filler system 340, via a fuel vapor line 334 and one or more vent valves, such as a fuel limit vent valve (FLVV) 346. An FTIV 320 may be actuated open or closed to allow fuel vapors to pass from the fuel tank 350 to the canisters 301 or seal the EVAP system from the fuel tank 350, and an FTPT 342 arranged on the fuel vapor line 334 may measure and/or monitor a pressure of the fuel system 305. Additionally, if the FTIV 320 is in an open position and the CVS 318 and the CPV 310 are in a closed position, the FTPT 342 may measure a pressure of the EVAP system. The CPV 310, CVS 318, FTIV 320, FTPT 342, and fuel tank 350 may be the same as or similar to the CPV 261, CVS 299, FTIV 252, FTPT 291, and fuel tank 220 of FIG. 2.

In the example EVAP system 300, the canisters 301 include a first canister 302, a second canister 304, and a third canister 306 coupled to the vent line 324 and the purge line 332. In one example, the first canister 302, the second canister 304, and the third canister 306 are arranged in a series, where fuel vapors originating in the fuel tank 350 may pass through the first canister 302, out of the first canister 302 into the second canister 304, and out of the second canister 304 into the third canister 306. Additionally, each of the canisters 301 may include a bypass conduit with a bypass valve, such that when a bypass valve is closed, fuel vapors originating in the fuel tank 350 may enter the respective canister, and when the bypass valve is open, the fuel vapors may not enter the respective canister and may bypass the respective canister via the respective bypass conduit. In the depicted example, a first bypass conduit 326 with a first bypass valve 312 bypasses the first canister 302, a second bypass conduit 328 with a second bypass valve 314 bypasses the second canister 304, and a third bypass conduit 330 with a third bypass valve 316 bypasses the third canister 306.

For example, during operation of the vehicle, the CVS 318 may be opened to atmosphere, generating a flow of fuel vapors from the fuel system 305 into the first canister 302; from the first canister 302 into the second canister 304; and from the second canister into the third canister 306. The flow of air through the first canister 302, the second canister 304, and third canister 306 (e.g., in order) may cause the first canister 302 to become loaded with fuel vapors before each of the second canister 304 and the third canister 306 become loaded. If the first canister 302 becomes loaded prior to the second canister 304 and the third canister 306, the first bypass valve 312 of the first canister 302 may be opened, thereby allowing the fuel vapors to bypass the first canister 302 via the first bypass conduit 326 and enter into the second canister 304. If the second canister 304 becomes loaded prior to the third canister 306 becoming loaded, the second bypass valve 314 of the second canister 304 may be opened, thereby allowing the fuel vapors to bypass the second canister 304 via the second bypass conduit 328 and enter into the third canister 306. By allowing the fuel vapors to bypass one or more fuel vapor canisters that become loaded, an efficiency of the EVAP system may be increased.

In one example, a controller of the vehicle estimates a loading of the first canister 302, the second canister 304, and/or the third canister 306 by estimating a combustion air/fuel ratio from an exhaust gas of the vehicle. The air/fuel ratio may be inferred from a measurement of oxygen in a sample of the exhaust gas via a universal exhaust gas oxygen (UEGO) sensor. For example, during a routine to estimate canister loading, the CPV may be slowly opened to allow air from the EVAP system to enter the engine, while a deviation of an air/fuel ratio from a stoichiometric air/fuel ratio is measured. If the deviation of the air/fuel ratio from a stoichiometric air/fuel ratio exceeds a threshold deviation (e.g., 30%), it may be inferred that one or more canisters are loaded. Further, one or more of the first bypass valve 312, the second bypass valve 314, and the third bypass valve 316 may be opened to selectively determine whether first canister 302, the second canister 304, and/or the third canister 306 are loaded. For example, the first canister 302 may be loaded, the second canister 304 may not be loaded, and the third canister 306 may not be loaded. The UEGO sensor may provide feedback to the controller that the deviation of the air/fuel ratio from the stoichiometric air/fuel ratio exceeds the threshold deviation, indicating that air filtered through the first canister 302, the second canister 304, and the third canister 306 is over-enriched. The controller may open the first bypass valve 312, whereby fresh air entering the EVAP system via the CVS 318 passes through the second canister 304 and the third canister 306, but passes through the first bypass conduit 326 and not through the first canister 302. As a result of the fresh air not passing through the first canister 302, the UEGO sensor may indicate that the deviation of the air/fuel ratio from the stoichiometric air/fuel ratio does not exceed the threshold deviation, whereby it may be inferred that the second canister 304 and the third canister 306 are not loaded. The controller may open the second bypass valve 314 and the third bypass valve 316, and close the first bypass valve 312, whereby fresh air entering the EVAP system via the CVS 318 does not pass through the second canister 304 and the third canister 306, but passes through the second bypass valve 328, the third bypass valve 330, and the first canister 302. As a result of the fresh air not passing through the second canister 304 and the third canister 306 and passing through the first canister 302, the UEGO sensor may indicate that the deviation of the air/fuel ratio from the stoichiometric air/fuel ratio exceeds the threshold deviation, whereby it may be inferred that the first canister 302 is loaded. Thus, a threshold fuel vapor load of a canister may be inferred from the threshold deviation of the air/fuel ratio.

Referring now to FIG. 3B, a flow diagram 360 shows a flow of fuel vapors through the example EVAP system 300 of FIG. 3A during a first condition such as canister load phase of the EVAP system 300. During the canister load phase, the CVS 318 is in an open position, the CPV 310 is in a closed position, and the FTIV 320 is in an open position, whereby fuel vapors generated in the fuel system 305 are drawn from the fuel system 305 through the open FTIV 320 and through the canisters 302, 304, and 306. The flow of the fuel vapors through the EVAP system 300 is shown by a dashed black line 362. Additionally, a dotted black line 364 shows an alternate path taken by the fuel vapors via the first bypass conduit 326, where the first bypass valve 312 has been opened to allow the fuel vapors to enter into the second canister 304 without first passing through the first canister 302. In one example, the first bypass valve 312 has been opened as a result of the controller determining that the first canister 302 has been loaded to the threshold fuel vapor load. Thus, the dashed black line 362 indicates a flow of the fuel vapors through the canisters 302, 304, and 306 when the first bypass valve 312, second bypass valve 314, and third bypass valve 316 are closed, and the dotted black line 364 indicates a flow of the fuel vapors through the canisters 304 and 306 when the first bypass valve 312 is open and the second bypass valve 314 and the third bypass valve 316 are closed.

FIG. 3C shows a flow diagram 370 indicating a flow of fuel vapors through the example EVAP system 300 of FIG. 3A during a second condition such as a canister purge phase of the EVAP system 300. During the canister purge phase, the CVS 318 is in an open position, the FTIV 320 is in a closed position, and the CPV 310 is actuated to an open position. When the CPV 310 is actuated to an open position, due to the lower engine intake manifold pressure, air from the EVAP system is evacuated to the intake manifold including fresh air entering the EVAP system 300 via the CVS 318. The fresh air flows through the canisters 306, 304, and 302 and to the purge line 332. As the fresh air flows through the canisters 306, 304, and 302, fuel vapors collected in the canisters 306, 304, and 302 are desorbed and routed to the purge line 332 to exit the EVAP system 300 into the engine intake manifold via the CPV 310. The fuel vapors may then be combusted in the engine cylinders. The flow of the fresh air through the canisters 306, 304, and 302 of the EVAP system 300 during the purge phase is shown by a dashed black line 372. Additionally, a dotted black line 374 shows an alternate path taken by the fresh air via the third bypass conduit 330, where the third bypass valve 316 has been opened to allow the fresh air to enter into the second canister 304 without first passing through the third canister 306. In one example, the third bypass valve 316 has been opened as a result of a controller determining that the third canister 306 has not been loaded to a threshold fuel vapor load, whereby the fresh air from the CVS 318 is diverted to the second canister 304 and the first canister 302 (e.g., because a fuel vapor load of the second canister 304 and/or the first canister 302 is greater than that of the third canister 306). Thus, the dashed black line 372 indicates a flow of the fresh air through the canisters 306, 304, and 302 when the first bypass valve 312, second bypass valve 314, and third bypass valve 316 are closed, and the dotted black line 374 indicates a flow of the fresh air through the canisters 304 and 302 when the first bypass valve 312 and the second bypass valve 314 are closed and the third bypass valve 316 is open.

FIG. 3D shows a flow diagram 380 during a fourth condition such as a diagnostics routine of the EVAP system 300 of FIG. 3A to test for a degradation in the CPV 310. During the diagnostics routine, the CVS 318 and the CPV 310 are actuated to a closed position, and the FTIV 320 is actuated to an open position. If no degradation exists in CPV 310, the EVAP system 300 and the fuel system 305 (including the fuel tank 350) may be sealed to atmosphere, whereby a pressure of the EVAP system 300 and the fuel system 305 may be maintained at a constant pressure. However, if a degradation exists in CPV 310, a negative pressure of the engine intake manifold (e.g., during operation of the vehicle when powered by an engine of the vehicle) may be transferred to the EVAP system 300, whereby the mixture of fresh air and fuel vapors may leak out through the CPV 310 to the engine intake manifold, thereby creating a flow of the mixture of fresh air and fuel vapors through the EVAP system 300 as a result of the negative pressure. The flow of the mixture of fresh air and fuel vapors from the CVS 318 and the fuel tank 350 through the canisters 306, 304, and 302 to the purge line 332 and the CPV 310 during the diagnostic routine is shown by a dashed black line 382.

As a result of the flow of the mixture of fresh air and fuel vapors through the CPV 310, the negative pressure of the engine intake manifold may be transferred to the EVAP system. Therefore, the diagnostic routine may monitor a pressure of the EVAP system 300 (and the fuel system 305) via the FTPT 342 to determine whether a degradation exists in the CPV 310. If a decrease in an EVAP system pressure is detected via the FTPT 342, the diagnostics routine may set a flag indicating a possible degradation of the CPV 310. If little or no decrease in the EVAP system pressure is detected by the FTPT (e.g., the pressure of the EVAP system 300 is maintained) the diagnostic routine may return an indication that no degradation was detected in the EVAP system 300.

However, if there is a large degradation in the CPV 310, the negative pressure of the engine vacuum may be rapidly transferred to the EVAP system 300. A large pressure drop of the EVAP system 300 and the fuel system 305 may cause damage to one or more elements of the fuel system 305 and/or the EVAP system 300, such as a deformation of the fuel tank 350, or a corking of the CVS 318, where the CVS 318 becomes stuck and may not be actuated open during a subsequent vent phase or purge routine. To avert possible damage, the CVS 318 may be actuated open if the pressure of the EVAP system drops below a threshold EVAP system pressure that is higher than a pressure at which the CVS becomes corked (herein, a corking pressure). In one example, the corking pressure may be determined in advance via one or more offline studies. In other examples, the corking pressure may be determined in advance from data previously collected from the vehicle, a similar vehicle, or a fleet of similar vehicles.

However, due to a positioning of the canisters 302, 304, and 306, a pressure of the EVAP system may not be equal across the EVAP system 300 and the fuel system 305, as a result of air flowing from the CVS 318 through the canisters 302, 304, and 306 to the CPV 310 faster than air and fuel vapors flowing from the fuel tank 350 through the canisters 302, 304, and 306 to the CPV 310. For example, a pressure at the FTPT 342 at a point in time may not be equal to a pressure at the CVS 318 at the (same) point in time. If negative pressure is generated at the CVS 318 more rapidly than the negative pressure generated at the FTPT 342, the pressure at the CVS 318 may reach the corking pressure before the pressure at the FTPT 342 reaches the threshold EVAP system pressure, whereby the CVS 318 becomes corked before being actuated open in response to the pressure at the FTPT 342 reaching the threshold EVAP system pressure as described above. Therefore, to ensure that the negative pressure is not generated at the CVS 318 at a different rate than the negative pressure generated at the FTPT 342, the first bypass valve 312, the second bypass valve 314, and the third bypass valve 316 may be opened. By opening the first bypass valve 312, the second bypass valve 314, and the third bypass valve 316, a passage may be opened between the vent line 324 on which the CVS is coupled and the vapor line 334 to which the FTPT is coupled, whereby an EVAP system pressure at the CVS 318 and an EVAP system pressure at the FTPT 342 at a point in time may be equalized. An additional advantage of equalizing the EVAP system pressure is that a volume over which negative pressure is generated (e.g., a volume of the EVAP system plus a volume of the fuel system) is increased, whereby a time taken before corking of the CVS occurs is extended, and a probability of CVS corking is reduced.

A dotted black line 384 shows an alternate path taken by the mixture of fresh air and fuel vapors via the first bypass conduit 326, the second bypass conduit 328, and the third bypass conduit 330, where the first, second, and third bypass valves 312, 314, and 316, respectively, have been opened. Thus, the dashed black line 382 indicates a flow of the mixture of fresh air and fuel vapors from the EVAP system 300 and the fuel system 305 through the canisters 302, 304, and 306 when the first bypass valve 312, second bypass valve 314, and third bypass valve 316 are closed, and the dotted black line 384 indicates an additional flow of the mixture of fresh air and fuel vapors from the EVAP system 300 and the fuel system 305 that bypasses the canisters 302, 304, and 306 when the first bypass valve 312, second bypass valve 314, and third bypass valve 316 are open.

Referring now to FIG. 3E, a flow diagram 390 is shown during a fifth condition such as a flow of fresh air through the example EVAP system 300 of FIG. 3A that bypasses one or more of the canisters during an engine idle-stop of the vehicle (e.g., during a traffic stop), in preparation for a hot restart of the engine. The vehicle may include an idle-stop mode, where the engine is switched off by a controller of the vehicle during an idle event (e.g., when stopping at a traffic light, etc.) to increase a fuel efficiency of the vehicle. When a driver of the vehicle commands the vehicle to initiate movement of the vehicle, the engine is switched on (referred to herein as the hot restart). During the hot restart, an air/fuel mixture from the EVAP system may flow into the engine intake manifold, where one or more fuel injectors inject fuel into the air/fuel mixture to power the engine. In one example, air entering the vent line 324 via the CVS 318 may generate a flow of fresh air through the canisters 302, 304, and 306 into the purge line 332 of the EVAP system 300, whereby fuel vapors may be desorbed from one or more canisters. The air/fuel mixture entering the purge line 332 may have an air/fuel ratio that is dependent on a load of fuel vapors in the canisters 302, 304, and 306, where if one or more of the canisters 302, 304, and 306 are loaded (e.g., from the vent phase described in relation to FIG. 3B), the air/fuel ratio may be low (e.g., a high percentage of fuel in the air), and if the canisters 302, 304, and 306 are not loaded, the air/fuel ratio may be high (e.g., a low percentage of fuel in the air).

If there is a degradation of the CPV, an efficiency of purging may be reduced, resulting in an increased load of the canisters 302, 304, and/or 306, and consequently the air/fuel ratio may be low. Further, the air/fuel ratio may be proportional to a size of the degradation of the CPV, where if the degradation is large, the load of one or more of the canisters 302, 304, and 306 may be high and the air/fuel ratio may be low, and if the degradation is small, the load of the canisters 302, 304, and 306 may not be high and the air/fuel ratio may be high. Further, if the size of the degradation of the CPV is not known, the air/fuel ratio may not be known. If the air/fuel ratio is not known, it may be difficult for the controller to estimate an amount of fuel to inject into the air/fuel mixture to produce a target final air/fuel ratio. For example, a composition of gasoline may be complex and may vary by region, season, brand, etc. In contrast, a composition of air may be simple and predictable (e.g., 78% nitrogen, 20% oxygen, etc.). If the air/fuel ratio is low (e.g., the air includes a high percentage of gasoline), a composition of the air/fuel mixture may not be accurately estimated, and therefore the amount of fuel injected into the air/fuel mixture may erroneous. However, if the air/fuel ratio is high (e.g., the air includes a low percentage of gasoline), a composition of the air/fuel mixture may be easier to estimate (e.g., since it is mostly air), and therefore the amount of fuel to inject into the air/fuel mixture may be accurately estimated to attain the target final air/fuel ratio. If the target final air/fuel ratio is not achieved, the engine may misfire or stall. Thus, by maximizing the air/fuel ratio prior to injecting fuel into the air/fuel mixture, the amount of fuel to inject into the air/fuel mixture to produce the target final air/fuel ratio may be more easily estimated.

In one example, the target air/fuel ratio is more reliably achieved by opening one or more of the first bypass valve 312, the second bypass valve 314, and the third bypass valve 316 to allow fresh air (e.g., from the CVS 318) to bypass one or more loaded canisters and be released into the engine intake manifold via the CPV 310. As a result of not passing through the one or more loaded canisters, the air/fuel ratio may be a high, and/or more easily estimated by the controller than if the fresh air passes through the one or more loaded canisters. As a result of the air/fuel ratio being high and/or easier to estimate, the controller may estimate the amount of fuel to inject into the air/fuel mixture to produce a target final air/fuel ratio more reliably, thereby reducing a probability of an engine misfire or stall upon the hot restart.

In the depicted flow diagram, the CVS 318 is an open position, the CPV 310 is in an open position, and the FTIV 320 is in a closed position, whereby an engine vacuum of the engine intake manifold is transferred to the EVAP system 300, drawing fresh air into the EVAP system 300 via the CVS 318. The canisters 304 and 306 may be heavily loaded (e.g., at or close to a threshold fuel vapor load), whereby the second bypass valve 314 has been opened to allow the fresh air to bypass the canister 304 via the bypass conduit 328, and the third bypass valve 316 has been opened to allow the fresh air to bypass the canister 306 via the bypass conduit 330. The flow of the fresh air through the EVAP system 300 is shown by a dashed black line 392, where the fresh air flows through the third bypass conduit 330 and the second bypass conduit 328 (e.g., and not through the canisters 306 and 304, respectively). Thus, the dashed black line 392 indicates a flow of the fresh air around the canisters 306 and 304, and through canister 302 to the purge line 332. As a result of the fresh air flowing around the canisters 306 and 304 and through canister 302 to the purge line 332, the air/fuel mixture may have a low air/fuel ratio, whereby the target air/fuel ratio may be reliably achieved by the controller by adjusting an amount of fuel injected into the air/fuel mixture by one or more fuel injectors. For example, a pulse width of the one or more fuel injectors may be increased to maintain a stoichiometric ratio. By reliably achieving the target air/fuel ratio, a probability of engine misfires and/or stalls may be reduced.

In other examples, the example EVAP system 300 may include an additional bypass conduit 394 with an additional bypass valve 396 that couples the vent line 324 to the purge line 332 at an opposite side of the canisters 302, 304, and 306 from the CVS 318, where the additional bypass conduit 394 allows the fresh air to bypass the canister 302, in addition to the canisters 304 and 306. For example, if the canisters 302, 304, and 306 are all heavily loaded, in addition to the second bypass valve 314 and then third bypass valve 316 being open, the first bypass valve 312 and the additional bypass valve 396 may be opened to allow the fresh air to bypass all of the canisters 302, 304, and 306.

Figure 4:
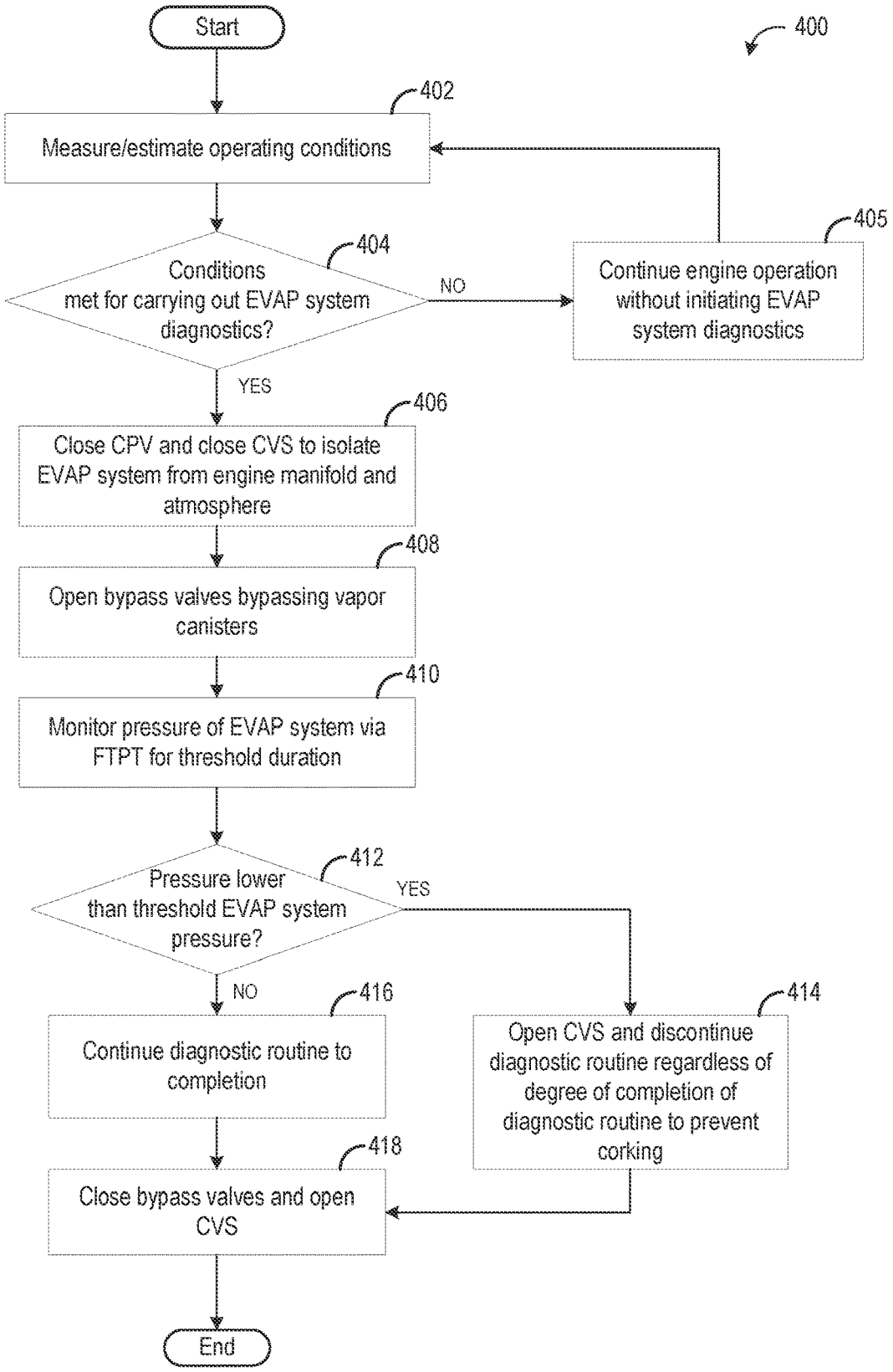
FIG. 4 shows a flowchart illustrating an example method for averting a corking of a CVS valve while running a diagnostic routine.

FIG. 4 shows an example method 400 for monitoring and inhibiting vacuum sealing of a CVS valve of an EVAP system coupled to a hybrid vehicle. The EVAP system may be the same as or similar to the EVAP system 251 of FIG. 2 and/or the EVAP system 300 of FIGS. 3A-3E. Instructions for carrying out method 400 and the rest of the methods included herein may be executed by a controller based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below.

At 402, method 400 includes estimating and/or measuring vehicle operating conditions of the vehicle. Vehicle operating conditions may be estimated based on one or more outputs of various sensors of the vehicle (e.g., such as oil temperature sensors, engine velocity or wheel velocity sensors, torque sensors, etc., as described above in reference to vehicle propulsion system 100 of FIG. 1). Vehicle operating conditions may include engine velocity and load, vehicle velocity, transmission oil temperature, exhaust gas flow rate, mass air flow rate, coolant temperature, coolant flow rate, engine oil pressures (e.g., oil gallery pressures), operating modes of one or more intake valves and/or exhaust valves, electric motor velocity, battery charge, engine torque output, vehicle wheel torque, etc. Estimating and/or measuring vehicle operating conditions may include determining whether the vehicle is being powered by an engine or an electric motor (e.g., the engine 110 or the electric motor 120 of vehicle propulsion system 100 of FIG. 1). Estimating and/or measuring vehicle operating conditions may include determining whether a purge routine of the EVAP system is being carried out.

At 404, method 400 includes determining whether conditions are met for carrying out diagnostics of the EVAP system. Diagnostics of the EVAP system may be carried out when a purge of one or more canisters of the EVAP system is not being carried out. As one example, conditions for carrying out diagnostics of the EVAP system may include engine operation at a threshold speed (e.g., a typical speed of operation of the vehicle). During engine operation at the threshold speed, engine rotation causes a negative pressure in an engine intake manifold. As another example, conditions for carrying out diagnostics of the EVAP system may include a temperature of one or more fuel system components being in a pre-calibrated temperature range. For example, temperatures that are above a threshold temperature (e.g., outside the pre-calibrated temperature range) may decrease accuracy of degradation detection. The conditions for carrying out diagnostics of the EVAP system may be based on whether auxiliary components, for example, air conditioning, heat, or other processes, are using more than a threshold amount of stored energy.

As yet another example, conditions for carrying out diagnostics of the EVAP system may include an amount of time elapsed since a prior diagnostic routine. For example, diagnostics may be performed on a set schedule, for example, diagnostic routine may be performed after a vehicle has traveled a certain amount of miles since a previous diagnostic routine or after a certain duration has passed since a previous diagnostic routine.

If at 404 it is determined that the conditions for carrying out EVAP system diagnostics are not met, method 400 proceeds to 405. At 405, method 400 includes continuing engine operation without initiating EVAP system diagnostics, and then proceeds back to 402, where method 400 includes continuing to measure/estimate operating conditions until conditions are met for carrying out EVAP system diagnostics. If at 404 it is determined that the conditions are met for carrying out EVAP system diagnostics, method 400 proceeds to 406. At 406, EVAP system diagnostics may be initiated by closing a CPV (such as CPV 261 of FIG. 2 and/or CPV 310 of FIGS. 3A-3E) housed in the purge line coupling one or more fuel vapor canisters (such as the canisters 222 of FIG. 2 and/or the canisters 302, 304, and 306 of FIGS. 3A-3E) of the EVAP system to the engine manifold and a CVS (such as CVS 299 in FIG. 2 and/or CVS 318 of FIGS. 3A-3E) coupled to a vent line of the EVAP system. The controller may send signals to respective actuators of each of the CPV and the CVS to command the respective valves to closed positions. Additionally, a fuel tank isolation valve (such as FTIV 252 of FIG. 2 and/or FTIV 320 of FIGS. 3A-3E) positioned on a fuel vapor line coupled to a fuel tank may be opened. The controller may send a signal to an actuator of the FTIV to actuate the FTIV to an open position. The EVAP system diagnostic routine (herein, the routine) may be carried out for a predetermined duration and a timer may be set to record a duration of the routine.

At 408, method 400 includes opening a plurality of bypass valves that bypass the one or more vapor canisters (e.g., the bypass valves 312, 314, and 316 of the vapor canisters 302, 304, and 306, respectively, of FIGS. 3A-3E). As described above in relation to FIG. 3D, by opening the bypass valves of each vapor canister of the one or more vapor canisters, a passage may be opened between the vent line on which the CVS is coupled and the vapor recovery line on which the FTPT is coupled, whereby a pressure of the EVAP system at the CVS and a pressure of the EVAP system at the FTPT is equalized.

Prior to executing the routine, the bypass valves may not be in a closed state and one or more of the bypass valves may be in an open state. In one example, the vehicle includes three vapor canisters, and the routine is executed at a time when a first vapor canister is loaded to a threshold fuel vapor load, where a first bypass valve of the first vapor canister is open, a second bypass valve of a second vapor canister is closed, and a third bypass valve of a third vapor canister is closed, to facilitate loading of the second vapor canister and/or the third vapor canister without fuel vapors passing through the first vapor canister. In another example, the routine is executed at a time when the first vapor canister and the second vapor canister are loaded to the threshold fuel vapor load, where the first bypass valve of the first vapor canister and the second bypass valve of the second vapor canister are open to facilitate loading of the third vapor canister without fuel vapors passing through the first vapor canister and/or second vapor canister. Thus, at 408, opening the plurality of bypass valves may include maintaining one or more of the plurality of bypass valves in an open state.

At 410, the pressure of the EVAP system (also referred to herein as the EVAP system pressure) may be monitored via the FTPT coupled to the vapor recovery line for a threshold duration of the routine. Due to the closure of the CPV and the CVS and opening of the FTIV, the EVAP system and the fuel system (also referred to as the fuel vapor system) may be isolated from the engine and also the atmosphere. Due to isolation of the fuel vapor system, a degradation in the EVAP system such as a leaky CPV may be detected by determining whether the EVAP system pressure monitored by the FTPT decreases (e.g., to a diagnostic threshold pressure, such as −4 InH20). If the pressure decreases, a flag may be set by the diagnostic routine indicating a degraded CPV. The threshold duration may correspond to the predetermined duration of the routine, which, in one example, may be determined based on a time taken for air to be evacuated from the EVAP system in the presence of a degradation. In one example, if the threshold duration after initiation of the EVAP diagnostic routine elapses without an indication of a degradation in the EVAP system, the EVAP system diagnostics routine returns an indication that no degradations were detected in EVAP system and/or be continued (e.g., to perform other diagnostics). Alternatively, if a degradation exists in the CPV and the CPV is at least partially open (such as due to a leak), the EVAP system may be fluidically connected to the engine intake manifold while being isolated from the atmosphere (e.g., the CVS being closed). Engine operation may cause the EVAP system to be evacuated as air from the EVAP system is drawn into the engine intake manifold. The vacuum (negative pressure) from the engine intake manifold may be transferred to the EVAP system and a drop in pressure may be detected via the FTPT over the threshold duration.

However, a high level of vacuum generated in the EVAP system may cause the CVS to be corked (vacuum sealed). In order to inhibit vacuum sealing of the CVS, the CVS may be opened if the EVAP system pressure at the CVS decreases to a threshold EVAP system pressure (e.g., a negative EVAP system pressure increases to the threshold EVAP system pressure). As a result of the EVAP system pressure being equalized via the bypass valves, the pressure of the EVAP system may be measured by the FTPT. The threshold EVAP system pressure may correspond to an EVAP system pressure below which the CVS may be corked and may not be actuated to an open position as desired. Therefore, by opening the CVS at the threshold EVAP system pressure, it may be ensured that the CVS is not corked shut. In one example, the threshold EVAP system pressure for corking is predetermined based on one or more offline studies and/or historical data of the vehicle and stored in a non-transitory memory of the controller (e.g., the memory 206 of the controller 212 of FIG. 2).

At 412, method 400 includes determining whether the EVAP system pressure, as estimated via the FTPT, is lower than a threshold EVAP system pressure at which the CVS may become corked. The EVAP system pressure is lower than the threshold EVAP system pressure when a magnitude of the (negative) EVAP system pressure is greater than a magnitude of the (negative) threshold EVAP system pressure. If the negative pressure is not lower than the threshold EVAP system pressure, the CVS valve does not become corked. If due to a degradation of the CPV air from the EVAP system is transferred to the engine intake manifold via the degraded CPV, the pressure in the EVAP system may drop to the threshold EVAP system pressure, whereby the CVS valve becomes corked. The CPV may have a small degradation, whereby a small amount of negative pressure is generated that is not lower than the threshold EVAP system pressure, or the CPV may have a large degradation, whereby a large amount of negative pressure is generated that is lower than the threshold EVAP system pressure.

If at 412 it is determined that the negative pressure exceeds the threshold EVAP system pressure, method 400 proceeds to 414. At 414, method 400 includes opening the CVS regardless of the degree of completion of the EVAP system diagnostics (e.g., to prevent corking). The controller may send a signal to the actuator of the CVS to actuate the CVS to an open position. In this way, by opening the CVS in a timely manner, vacuum sealing of the CVS may be averted and robustness of the EVAP system may be maintained. Once the CVS is opened, the EVAP system diagnostics may be discontinued. Alternatively, if at 412 it is determined that the EVAP system pressure does not fall below the threshold EVAP system pressure, it may be inferred that the EVAP system pressure is not low enough for the CVS to be corked and method 400 proceeds to 416.

At 416, method 400 includes continuing the EVAP system diagnostic routine to completion. Completing the EVAP system diagnostic routine may include determining whether the diagnostic threshold pressure is reached, indicating a degradation in the EVAP system. For example, a flag may be set indicating a degradation of the EVAP system such as a leak in the CPV. Further, the degree of degradation (size of leak) of the CPV may be estimated from a final EVAP system pressure at the end of the diagnostic routine or a time to reach the threshold EVAP system pressure from the initiation of the diagnostic routine. For example, a difference between an initial EVAP system pressure and the final EVAP system pressure at the end of the diagnostic routine may be proportional to a size of the leak in the CPV, or an amount of time to reach the threshold EVAP system pressure may be indirectly proportional to the size of the leak, where a short amount of time is taken to reach the threshold EVAP system pressure in the event of a large leak, and a long amount of time is taken to reach the threshold EVAP system pressure in the event of a large leak.

Upon detection of a degradation of the EVAP system, vehicle operating conditions may be adjusted. In one example, a canister purge schedule may be updated based on the indication of undesired evaporative emissions. Further, an evaporative emissions test schedule may be updated, as a result of the indication of the CPV being degraded. For example, future evaporative emissions tests may be postponed until it is indicated that the degraded CPV has been evaluated. Further, canister purge operations may be scheduled to be conducted more frequently, such that vapors in the fuel system and/or EVAP system may be purged to engine intake for combustion, rather than being released to atmosphere. In a still further example, due to the indication of the CPV being degraded, the vehicle may be scheduled to run in an electric mode whenever possible, to limit fuel tank vacuum which may develop during engine-on conditions as a result of the CPV that is degraded.

Alternatively, if it is determined that the EVAP system pressure has not decreased to the diagnostic threshold pressure over the threshold duration, it may be inferred that the EVAP system is not degraded and the CPV does not have a leak, and an indication that no degradation was detected in the EVAP system may be returned, and the EVAP system diagnostics may be concluded.

At 418, method 400 includes closing the bypass valves (e.g., in preparation for a next purge routine) and opening the CVS. The CVS and may be actuated to an open position to unseal the fuel vapor system.

In this way, upon conditions for conducting the diagnostic routine for the EVAP system being met, the EVAP system may be sealed by closing each of the CVS and the CPV to initiate the diagnostic routine for the threshold duration. The EVAP system pressure may be monitored via the FTPT, and in response to the EVAP system pressure decreasing to the threshold EVAP system pressure, the CVS may be opened regardless of a degree of completion of the threshold duration, thereby averting a development of a corking pressure at the CVS.

Figure 5:
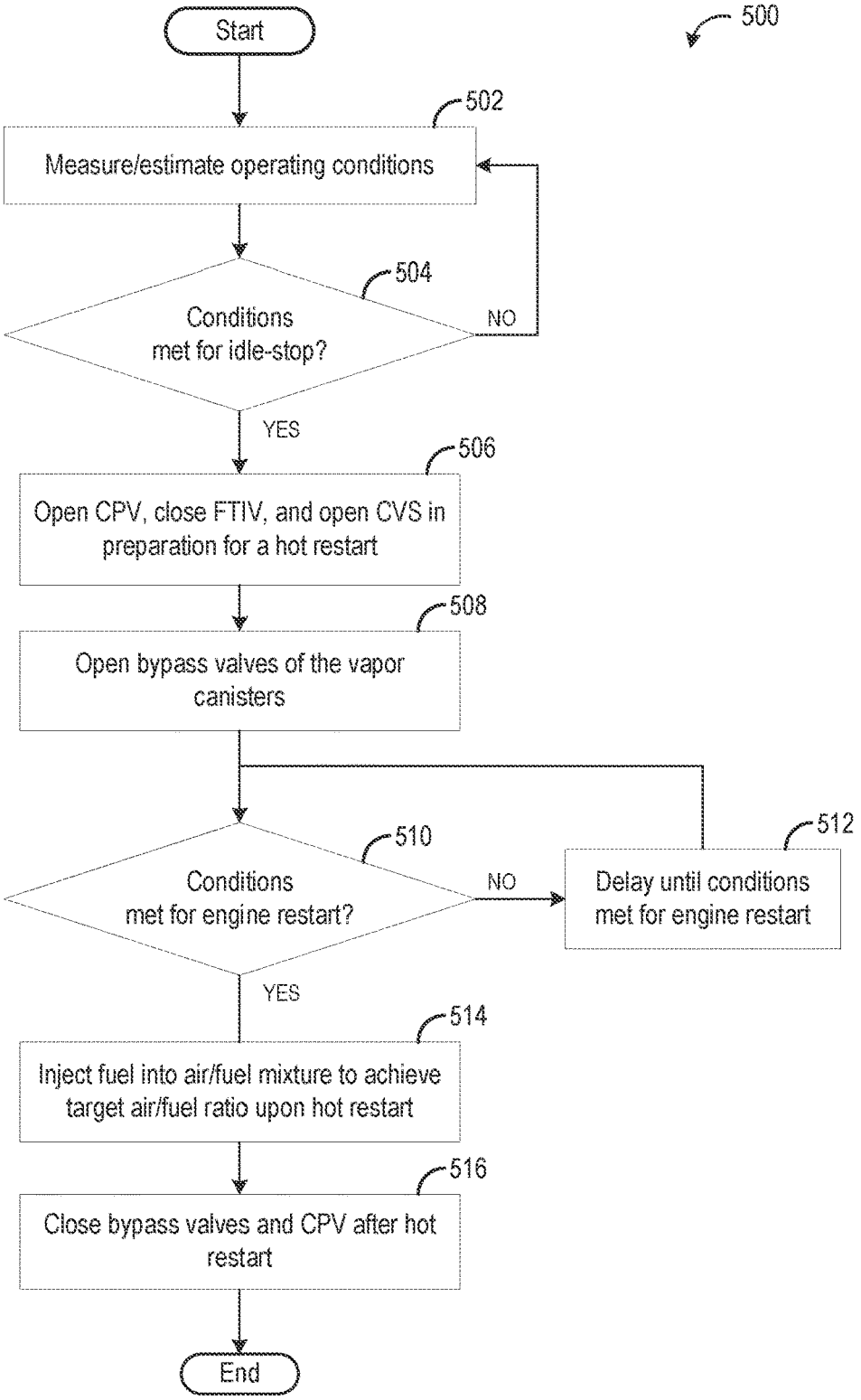
FIG. 5 shows a flowchart illustrating an example method for bypassing one or more vapor canisters during a hot restart of the vehicle propulsion system.
Figure 6:
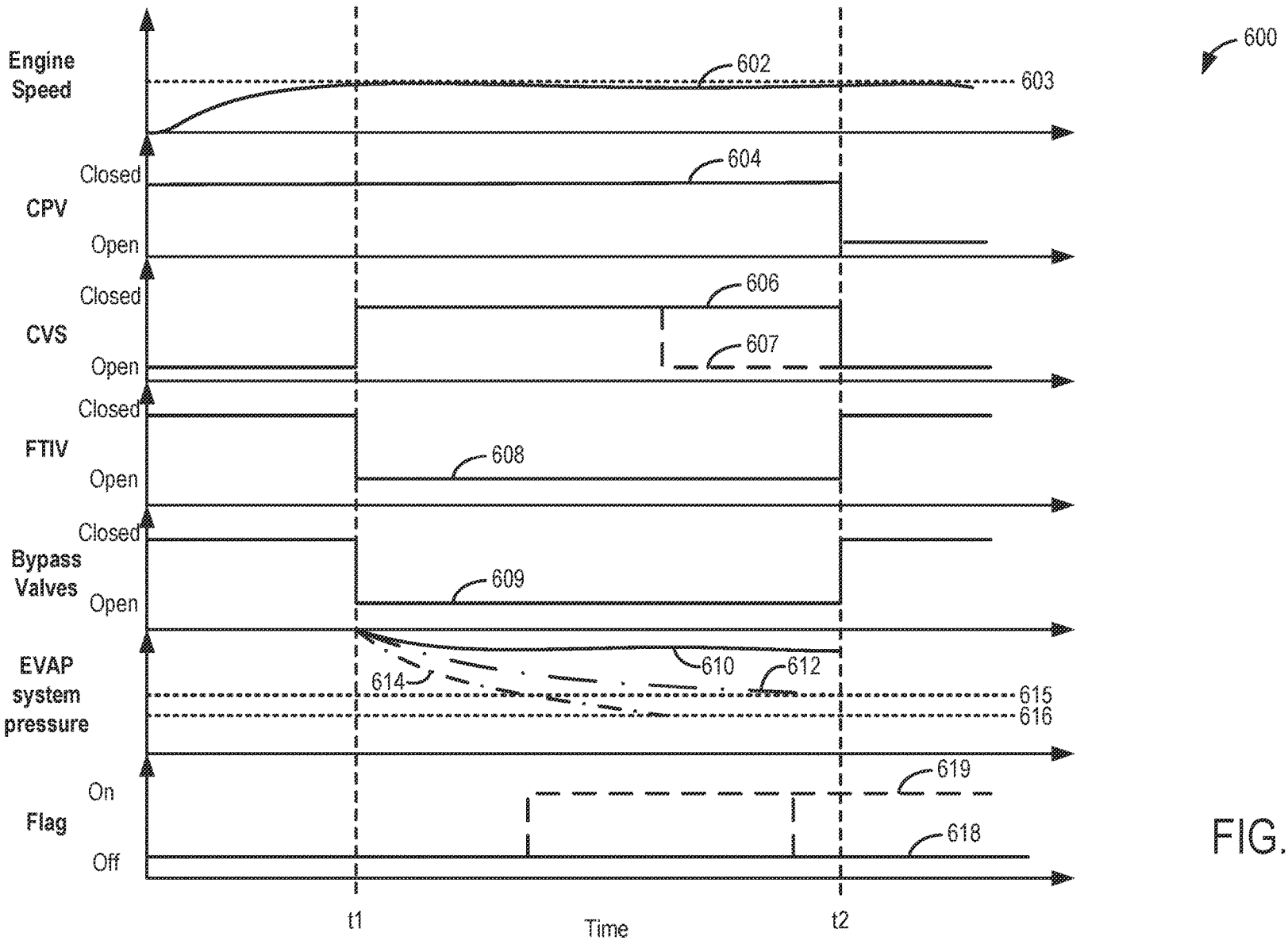
FIG. 6 shows an example monitoring of EVAP system valve positions during a diagnostic routine.

FIG. 5 shows an example method 500 for bypassing one or more vapor canisters of an EVAP system (e.g., the EVAP system 300 of FIG. 3A-3E) of a vehicle to allow a flow of fresh air with a high and predictable air/fuel ratio to be supplied to an engine intake manifold of the vehicle during a hot restart after an engine idle-stop event. During an engine idle-stop event, a stop-start controller of the vehicle automatically suspends combustion (shuts off an engine of the vehicle) in response to a set of operating conditions having been met, until a threshold time has elapsed and/or a change in the operating conditions occurs. In one example, the set of operating conditions includes the vehicle being in a stopped condition at a location of a traffic stop, and the change in operating conditions includes an engagement of one or more gears of a transmission of the vehicle as the vehicle proceeds through the traffic stop. For example, when a stop-start function is enabled, the stop-start controller may automatically shut off the engine when the vehicle is waiting at a stoplight to increase a fuel efficiency of the vehicle.

At 502, method 500 includes estimating and/or measuring vehicle operating conditions of the vehicle, as described above in reference to method 400. Estimating and/or measuring vehicle operating conditions may include determining whether a stop-start system of the vehicle is enabled. At 504, method 500 includes determining whether conditions are met for the idle-stop event (e.g., for turning the engine off). Conditions for engine idle-stop may include engine idling for a longer than threshold duration. For example, engine idling may take place while the vehicle is at a traffic stop when the engine load is below a threshold (such as when the vehicle is stationary). Engine operation at the idling speed for a longer than threshold duration may result in increased fuel usage and increased level of exhaust emissions. Also, the threshold duration may be based on fuel level in the fuel tank. In one example, if the fuel level in the fuel tank is lower than a threshold level, the threshold duration may be decreased such that additional fuel may not be consumed for engine idling.

Engine idle-stop conditions may further include a greater then battery state of charge (SOC). The controller may check battery SOC against a preset minimum threshold and if it is determined that the battery SOC is at least more that 30% charged, automatic engine stop may be enabled. Confirming engine idle-stop conditions may further include an indication that a motor of a starter/generator is operation ready. The status of an air conditioner may be checked and before initiating an engine idle-stop, it may be verified that the air conditioner did not issue a request for restarting the engine, as may be requested if air conditioning is desired. The intake air temperature may be estimated and/or measured to determine if it is within a selected temperature range. In one example, the intake temperature may be estimated via a temperature sensor located in the intake manifold and an engine idle-stop may be initiated when the intake air temperature is above a threshold temperature. Also, the engine temperature may be estimated and/or measured to determine if it is within a selected temperature range. In one example, the engine temperature may be inferred from an engine coolant temperature and an engine idle-stop may be initiated when the engine coolant temperature is above a threshold engine temperature. The driver requested torque may be estimated and confirmation of an engine idle-stop may be initiated in response to a lower than threshold driver requested torque. The vehicle speed may be estimated and assessed whether it is below a predetermined threshold. For example, if the vehicle speed is lower than a threshold (e.g., 3 mph) an engine ide-stop may be requested even if the vehicle is not at rest. Further, an emission control device coupled to the exhaust manifold of engine may be analyzed to determine that no request for engine restart was made.

If at 504 conditions are not met for the idle-stop event, method 500 proceeds to 502, where method 500 includes continuing to measure/estimate operating conditions until conditions are met for the idle-stop event. If at 504 conditions are met for the idle-stop event, method 500 proceeds to 506.

If at 504 it is determined that the conditions are met for the idle-stop event, method 500 proceeds to 506. At 506, a CPV of the vehicle (such as CPV 261 of FIG. 2 and/or CPV 310 of FIGS. 3A-3E) housed in the purge line coupling one or more fuel vapor canisters (such as the canisters 222 of FIG. 2 and/or the canisters 302, 304, and 306 of FIGS. 3A-3E) of the EVAP system to the engine manifold and a CVS (such as CVS 299 in FIG. 2 and/or CVS 318 of FIGS. 3A-3E) coupled to a vent line of the EVAP system are opened in preparation for a hot restart. The controller may send signals to an actuator of each of the CPV and the CVS to command the respective valves to closed positions. Additionally, a fuel tank isolation valve (such as FTIV 252 of FIG. 2 and/or FTIV 320 of FIGS. 3A-3E) positioned on a fuel vapor line coupled to a fuel tank may be closed. The controller may send a signal to an actuator of the FTIV to actuate the FTIV to an open position.

At 508, method 500 includes opening one or more bypass valves that bypass the one or more vapor canisters (e.g., the first bypass valve 312, second bypass valve 314, and third bypass valve 316 of the vapor canisters 302, 304, and 306, respectively, of FIGS. 3A-3E). As described above in relation to FIG. 3E, by opening one or more bypass valves of the one or more vapor canisters, a passage may be opened for fresh air entering the EVAP system via the CVS to flow to the CPV without entering the one or more vapor canisters that are bypassed. Prior to executing the routine, the one or more bypass valves may not be in a closed state and one or more of the one or more bypass valves may be in an open state. As a result, at 508, opening the one or more bypass valves may include maintaining one or more of the one or more bypass valves in an open state.

As described above in relation to FIG. 3E, opening the one or more bypass valves may allow a flow of air into the engine to have a higher air/fuel ratio than if the flow of air into the engine first passes through the one or more vapor canisters. As a result of the higher air/fuel ratio, the controller may reliably estimate an amount of fuel to inject into the air/fuel mixture to achieve a target final air/fuel ratio (e.g., after injecting the amount of fuel into the air/fuel mixture). By achieving the target final air/fuel ratio, engine stalls and/or misfires may be averted. In one example, the one or more vapor canisters are loaded with fuel vapors, whereby the air/fuel ratio is higher as a result of opening the one or more bypass valves, because the air/fuel mixture bypasses the one or more vapor canisters and thus is not exposed to fuel vapors of the one or more vapor canisters. For example, the one or more vapor canisters may be loaded with fuel vapors due to a degradation of the CPV, where the CPV may leak, thereby reducing an efficiency of purging of the EVAP system.

At 510, the method 500 includes determining if engine restart conditions are met. In one example, engine restart conditions following an engine idle-stop may include an increase in engine load. In one example, the controller may determine if the brake pedal is released. The accelerator pedal position may also be determined, for example via a pedal position sensor, to determine whether the accelerator pedal has been engaged in addition to the release of the brake pedal. The status of the air conditioner may be checked to verify whether a request has been made to restart, as may be made when air conditioning is desired. The SOC of battery may be estimated to estimate if it is below a predetermined threshold. In one example, it may be desired that battery be at least 30% charged. Accordingly, engine starting may be requested to charge the battery to a desired value.

The engine restart conditions may further include a request from an emission control device to restart the engine having been made. In one example, the emission control device temperature may be estimated and/or measured by a temperature sensor, and if the temperature is below a predetermined threshold, an engine restart may be requested. It may be determined whether the electrical load of the engine is above a predetermined threshold, in response to which an engine start is requested (e.g., to reduce draining of the battery). In one example, the electrical load may comprise user operated accessory devices, electrically powered air-conditioning, etc.

If at 510 it is determined that conditions are not met for an engine restart, method 500 proceeds to 512. At 512, method 500 includes delaying until conditions are met for an engine restart. If at 510 it is determined that conditions are met for an engine restart, method 500 proceeds to 514. At 514, method 500 includes injecting fuel into the air/fuel mixture to achieve the target air/fuel ratio upon the hot restart. As a result of the air/fuel ratio of the air/fuel mixture being high prior to injecting the fuel, the air/fuel ratio may be more reliably estimated and the target air/fuel ratio may be more reliably achieved. At 516, method 500 includes closing the bypass valves and closing the CPV after the hot restart, and method 500 ends.

FIG. 6 shows an example operating sequence 600 illustrating monitoring valve positions during a diagnostic routine of an EVAP system (such as the EVAP system 300 of FIG. 3D) of a vehicle. The diagnostic routine includes sealing the EVAP system and monitoring a change in pressure in the EVAP system. The horizontal (x-axis) denotes time and the vertical markers t1-t2 identify significant times in the diagnostics of the EVAP system.

The first plot, line 602, shows a change in engine speed, as estimated via a crankshaft position sensor, over time. Dashed line 603 denotes a travelling speed of the engine during normal operation. The second plot, line 604, shows a position of a CPV of the EVAP system (such as CPV 310 of FIGS. 3A-3E) coupled to a purge line of the EVAP system.

The third plot, line 606, shows a position of a CVS (such as CVS 318 of FIGS. 3A-3E) coupled to a vent line of the EVAP system. The fourth plot, line 608, shows a position of an FTIV (such as FTIV 320 of FIGS. 3A-3E) coupled to a fuel vapor line of the EVAP system. The fifth plot, line 609, shows a position of one or more canister bypass valves (such as the bypass valves 312, 314, and 316 of FIGS. 3A-3E) coupled to bypass conduits of the vent line and/or the purge line of the EVAP system. As described above in reference to FIGS. 3A-3E, each vapor canister of one or more vapor canisters of the EVAP system may have a bypass conduit with a bypass valve that allows a flow of air and/or fuel vapors to bypass the respective canister. During the diagnostic routine described herein, the bypass valves 312, 314, and 316 have the same state and are actuated in unison, where either the bypass valves 312, 314, and 316 are all open, or the bypass valves 312, 314, and 316 are all closed. The sixth plot, line 610, shows a change in EVAP system pressure, as estimated via a EVAP system pressure sensor (such as FTPT 342 of FIGS. 3A-3E), during the course of the diagnostic routine. Dashed line 615 denotes a diagnostic threshold pressure below which it is determined that the EVAP system is degraded. Dashed line 616 denotes a threshold EVAP system pressure at which the CVS is actuated to an open position even if the diagnostic routine has not been completed (e.g., the threshold EVAP system pressure is lower than the diagnostic threshold pressure). The seventh plot, lines 618 and 619, denote a flag (such as a diagnostic code) indicating a degradation of the EVAP system such as a leak in the CPV. Line 618 denotes a situation where the flag is not set (e.g., no degradation is detected), while line 619 denotes situations where a flag is set (e.g., a degradation is detected).

Prior to time t1, the engine is started from rest and the engine speed gradually increases as the vehicle is operated until reaching the travelling speed 603. The CVS is in an open position while the CPV and the FTIV are in a closed position. The flag is maintained in the off state since a degradation of the EVAP system has not yet been identified.

At time t1, diagnostics of the EVAP system is initiated by sealing the fuel vapor system, where the predetermined duration of the diagnostic routine is from time t1 to time t2. In order to seal the fuel vapor system, the CVS is commanded by the controller to a closed position while the FTIV is commanded open. Additionally, the bypass valves are commanded open, which allows differences in pressure at different locations within the EVAP system and/or the fuel system to equalize rapidly (e.g., as opposed to the differences in pressure at different locations equalizing slowly via air flow through the one or more vapor canisters). As a result of opening the bypass valves, the EVAP system pressure at the CVS on the vent line may be measured accurately and opportunely by the FTPT on the fuel vapor line. Due to sealing of the EVAP system, the EVAP system pressure estimated at the FTPT stabilizes and remains significantly unchanged over the course of the diagnostic routine, as shown by line 610. The unchanged pressure signifies that no degradation is detected in the EVAP system lines or valves, and air from the EVAP system is not leaking out to the engine manifold or the atmosphere.

At time t2, upon conclusion of the period for the diagnostics routine, based on the EVAP system pressure being higher than each of the diagnostic threshold pressure 615 and the threshold EVAP system pressure 616, it is inferred that the EVAP system is not degraded and the flag is maintained in the off state. Also, at time t2, upon completion of the diagnostic routine, the CVS is commanded open, the bypass valves are commanded closed, and engine operation is continued.

However, as an example, if during the course of the diagnostic routine, as shown by dashed line 612, if it is observed that the estimated EVAP system pressure reduces to the diagnostic threshold pressure, it is inferred that there is a degradation of the EVAP system. Due to the degradation (such as a leak), air from the EVAP system is drawn into an engine intake manifold by the rotating engine, thereby causing the EVAP system pressure to decrease to the diagnostic threshold pressure (e.g., a negative pressure of the EVAP system increases). Accordingly, the flag is turned on (as shown by dashed line 619) and a diagnostic code is set indicating the degradation.

As another example, if during the course of the diagnostic routine, as shown by dashed line 614, if it is observed that the estimated EVAP system pressure decreases to the threshold EVAP system pressure, the CVS is commanded to an open position prior to completion of the routine at time t2, as shown by line 607. By opening the CVS in a timely manner, corking (e.g., vacuum sealing) of the CVS is averted. As with line 612, in response to the decrease of the EVAP system pressure to the diagnostic threshold pressure (even if it quickly decreases further to the EVAP system pressure), the flag may be turned on by the diagnostic routine (as shown by dashed line 619, at the intersection of line 614 and line 615) and a diagnostic code set indicating the degradation.

In this way, a threshold EVAP system pressure at which the CVS may be opportunistically opened to avert corking of the CVS at an increased level of negative pressure, may be determined by an FTPT of a fuel system coupled to the EVAP system, even when one or more vapor canisters are arranged between the FTPT and the CVS. By opening one or more bypass valves, each of the one or more bypass valves coupled to a bypass conduit that bypasses a respective vapor canister, an air passage between the FTPT and the CVS is opened whereby air may flow between the FTPT and the CVS without passing through the one or more canisters. As a result, an EVAP system pressure and a fuel system pressure may equalize, where the EVAP system pressure may be accurately and opportunely measured and/or monitored via the FTPT of the fuel system. By ensuring an accurate measurement of the EVAP system pressure at the CVS, CVS corking may be averted by opening the CVS if the EVAP system pressure decreases to the threshold EVAP system pressure (e.g., in the event of a CPV degradation). An additional advantage of opening the bypass valves to equalize the EVAP system pressure during the routine is that a generation of negative pressure in the EVAP system due to a degraded CPV is slowed down, thereby providing an additional time to open the CVS and reducing a probability that the CVS becomes corked. Another additional advantage of opening the bypass valves is that fresh air entering the EVAP system via the CVS may be routed to the CPV without passing through the one or more canisters, thereby ensuring that fuel is injected into a flow of air with a predictable and low air/fuel ratio during a hot restart (e.g., after an idle-stop event).

The technical effect of opening the bypass valves during negative pressure generation is that a difference in the EVAP system pressure as measured by the FTPT and the EVAP system pressure as experienced at the CVS may be reduced or eliminated, and that fresh air from the CVS may bypass one or more loaded canisters when performing a hot restart of the engine.

The disclosure also provides support for a method for an evaporative emissions control (EVAP) system of a vehicle, comprising, after isolating the EVAP system from atmosphere, opening one or more bypass valves of one or more fuel vapor canisters, and opening a canister vent valve (CVS) responsive to an EVAP system pressure decreasing to a threshold EVAP system pressure. In a first example of the method, isolating the EVAP system from the atmosphere includes at least one of closing a canister purge valve (CPV) of the EVAP system, closing the CVS, and opening or maintaining open a fuel tank isolation valve (FTIV) of the EVAP system. In a second example of the method, optionally including the first example, each bypass valve of the one or more bypass valves bypasses a respective vapor canister of one or more vapor canisters. In a third example of the method, optionally including the first and second examples, opening each bypass valve of the one or more fuel vapor canisters includes maintaining one or more bypass valves of the one or more fuel vapor canisters in an open position. In a fourth example of the method, optionally including the first through third examples, the threshold EVAP system pressure is greater than a corking pressure of the CVS. In a fifth example of the method, optionally including the first through fourth examples, the EVAP system is isolated from the atmosphere as part of a diagnostic routine of the EVAP system. In a sixth example of the method, optionally including the first through fifth examples, the EVAP system pressure decreases to the threshold EVAP system pressure as a result of air from the EVAP system flowing to an engine intake manifold of the vehicle due to a degraded CPV of the EVAP system. In a seventh example of the method, optionally including the first through sixth examples, opening each bypass valve of the one or more fuel vapor canisters couples the EVAP system to a fuel system of the vehicle, and the EVAP system pressure is measured by a fuel tank pressure transducer (FTPT) of the fuel system to determine whether the EVAP system pressure decreases to the threshold EVAP system pressure. In an eighth example of the method, optionally including the first through seventh examples, the method further comprises, in a first condition, in response to the EVAP system pressure decreasing to the threshold EVAP system pressure, opening the CVS prior to a completion of the diagnostic routine, in a second condition, in response to the EVAP system pressure not decreasing to the threshold EVAP system pressure, not opening the CVS. In a ninth example of the method, optionally including the first through eighth examples, the method further comprises, responsive to the EVAP system decreasing to the threshold EVAP system pressure, inferring that a degradation exists in the CPV, and responsive to the EVAP system not decreasing to the threshold EVAP system pressure, inferring that no degradation exists in the CPV. In a tenth example of the method, optionally including the first through ninth examples, the method further comprises closing one or more bypass valves after completing the diagnostic routine.

The disclosure also provides support for a method for an evaporative emissions control (EVAP) system of a vehicle, comprising, during an idle-stop event of the vehicle, with a canister vent valve (CVS) of the EVAP system open, a canister purge valve (CPV) of the EVAP system open, and a fuel tank isolation valve (FTIV) of a fuel system of the vehicle closed, opening one or more bypass valves coupled to one or more fuel vapor canisters of the EVAP system to directly flow fresh air entering the EVAP system via the CVS to the CPV, bypassing the one or more fuel vapor canisters. In a first example of the method, each bypass valve of the one or more bypass valves bypasses a respective vapor canister of one or more vapor canisters. In a second example of the method, optionally including the first example, the respective vapor canisters are bypassed in response to at least one of a degradation of the CPV being detected, a fuel vapor load of one or more fuel vapor canisters exceeding a threshold fuel vapor load, and a temperature of a fuel of the vehicle exceeding a threshold temperature. In a third example of the method, optionally including the first and second examples, the respective vapor canisters are bypassed if no degradation of the CPV is detected, the fuel vapor load does not reach the threshold fuel vapor load, and the temperature of the fuel does not reach the threshold temperature.

The disclosure also provides support for a system for controlling an evaporative emissions control (EVAP) system of a vehicle, comprising a controller with computer readable instructions stored on non-transitory memory that when executed during operation of the vehicle, cause the controller to, in a first condition, seal the EVAP system to atmosphere, open each bypass valve of one or more bypass valves to allow a flow of air through the EVAP system to bypass one or more respective canisters of the EVAP system, monitor an EVAP system pressure, in response to the EVAP system pressure decreasing to a threshold EVAP system pressure, open canister vent valve (CVS) of the EVAP system to prevent the CVS from corking, and in a second condition, open the CVS, open each bypass valve of the one or more bypass valves to allow the flow of air through the EVAP system to bypass the one or more respective canisters of the EVAP system, open a canister purge valve (CPV) of the EVAP system to draw the flow of air that bypasses the one or more vapor canisters into an engine intake manifold of the vehicle. In a first example of the system, sealing the EVAP system to atmosphere includes closing the CVS, closing the CPV, and opening a fuel tank isolation valve (FTIV) of a fuel system of the vehicle, the fuel system coupled to the EVAP system. In a second example of the system, optionally including the first example, the first condition occurs during a diagnostic routine of the EVAP system and the controller includes further instructions to open the CVS regardless of a state of completion of the diagnostic routine, and the second condition occurs during an idle-stop event in preparation for a hot restart of an engine of the vehicle. In a third example of the system, optionally including the first and second examples, the controller includes further instructions to, in response to the EVAP system pressure not decreasing to the threshold EVAP system pressure, not open the CVS.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an evaporative emissions control (EVAP) system of a vehicle, comprising:

after isolating the EVAP system from atmosphere;

opening each bypass valve of one or more bypass valves of one or more fuel vapor canisters to couple the EVAP system to a fuel system of the vehicle; and opening a canister vent valve (CVS) responsive to an EVAP system pressure decreasing to a threshold EVAP system pressure.

2. The method of claim 1, wherein isolating the EVAP system from the atmosphere includes at least one of closing a canister purge valve (CPV) of the EVAP system, closing the CVS, and opening or maintaining open a fuel tank isolation valve (FTIV) of the EVAP system.

3. The method of claim 1, wherein each bypass valve of the one or more bypass valves bypasses a respective vapor canister of the one or more fuel vapor canisters.

4. The method of claim 1, wherein opening each bypass valve of the one or more fuel vapor canisters includes maintaining one or more bypass valves of the one or more fuel vapor canisters in an open position.

5. The method of claim 1, wherein the threshold EVAP system pressure is greater than a pressure at which the CVS is corked closed.

6. The method of claim 1, wherein the isolating of the EVAP system from the atmosphere is carried out during a diagnostic routine of the EVAP system.

7. The method of claim 6, wherein the EVAP system pressure decreases to the threshold EVAP system pressure due to a flow of air from the EVAP system to an engine intake manifold of the vehicle via a degraded CPV of the EVAP system.

8. The method of claim 7, wherein the EVAP system pressure is measured by a fuel tank pressure transducer (FTPT) of the fuel system to detect a decrease of the EVAP system pressure to the threshold EVAP system pressure.

9. The method of claim 7, further comprising, in a first condition, in response to the EVAP system pressure decreasing to the threshold EVAP system pressure, opening the CVS prior to a completion of the diagnostic routine;

in a second condition, in response to the EVAP system pressure not decreasing to the threshold EVAP system pressure, not opening the CVS until the diagnostic routine is completed.

10. The method of claim 7, further comprising closing one or more of the one or more bypass valves after completing the diagnostic routine.

11. A system for controlling an evaporative emissions control (EVAP) system of a vehicle, comprising:

a controller with computer readable instructions stored on non-transitory memory that when executed during operation of the vehicle, cause the controller to:

in a first condition:

seal the EVAP system to atmosphere;

open each bypass valve of one or more bypass valves to allow a flow of air through the EVAP system to bypass one or more respective canisters of the EVAP system;

monitor an EVAP system pressure;

in response to the EVAP system pressure decreasing to a threshold EVAP system pressure, open canister vent valve (CVS) of the EVAP system prior to the CVS corking; and in a second condition:

open the CVS;

open each bypass valve of the one or more bypass valves to allow the flow of air through the EVAP system to bypass the one or more respective canisters of the EVAP system;

open a canister purge valve (CPV) of the EVAP system to draw the flow of air that bypasses the one or more vapor canisters into an engine intake manifold of the vehicle.

12. The system of claim 11, wherein sealing the EVAP system to atmosphere includes:

closing the CVS;

closing the CPV; and opening a fuel tank isolation valve (FTIV) of a fuel system of the vehicle, the fuel system coupled to the EVAP system.

13. The system of claim 12, wherein in the first condition, the controller includes further instructions to:

monitor the EVAP system pressure via a fuel tank pressure transducer (FTPT) of the fuel system.

14. The system of claim 13, wherein after opening each bypass valve of the one or more bypass valves, a measurement of the EVAP system pressure at the FTPT is equal to the EVAP system pressure at the CVS.

15. The system of claim 11, wherein:

the first condition occurs during a diagnostic routine of the EVAP system and the controller includes further instructions to open the CVS regardless of a state of completion of the diagnostic routine; and the second condition occurs during an idle-stop event in preparation for a hot restart of an engine of the vehicle.

16. The system of claim 11, wherein the controller includes further instructions to:

in response to the EVAP system pressure not decreasing to the threshold EVAP system pressure, not open the CVS.

* * * * *